US008687648B2

(12) United States Patent
Jacobs et al.

(10) Patent No.: US 8,687,648 B2
(45) Date of Patent: Apr. 1, 2014

(54) WIRELESS TRANSMISSION OF DATA USING AN AVAILABLE CHANNEL OF A SPECTRUM

(75) Inventors: Paul E. Jacobs, San Diego, CA (US); Steven R. Altman, San Diego, CA (US); Vijayalakshmi R. Raveendran, San Diego, CA (US); Yu A. Wang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 632 days.

(21) Appl. No.: 12/831,512

(22) Filed: Jul. 7, 2010

(65) Prior Publication Data

US 2011/0069720 A1 Mar. 24, 2011

Related U.S. Application Data

(63) Continuation-in-part of application No. 12/547,834, filed on Aug. 26, 2009, now Pat. No. 8,374,134.

(60) Provisional application No. 61/226,608, filed on Jul. 17, 2009, provisional application No. 61/295,495, filed on Jan. 15, 2010.

(51) Int. Cl.
*H04J 3/16* (2006.01)

(52) U.S. Cl.
USPC ..... 370/465; 370/469

(58) Field of Classification Search
None
See application file for complete search history.

(56) References Cited

U.S. PATENT DOCUMENTS

| | | | | |
|---|---|---|---|---|
| 6,810,233 | B2 | 10/2004 | Patsiokas | |
| 7,401,350 | B1 | 7/2008 | Asada | |
| 2002/0102992 | A1 | 8/2002 | Koorapaty et al. | |
| 2002/0106987 | A1 * | 8/2002 | Linden | 455/12.1 |
| 2002/0133545 | A1 | 9/2002 | Fano et al. | |
| 2004/0203814 | A1 | 10/2004 | Ho et al. | |
| 2004/0240415 | A1 | 12/2004 | Lane | |
| 2005/0028207 | A1 | 2/2005 | Finseth et al. | |
| 2006/0034326 | A1 * | 2/2006 | Anderson et al. | 370/466 |
| 2006/0039483 | A1 | 2/2006 | Lee et al. | |
| 2006/0084444 | A1 | 4/2006 | Kossi et al. | |

(Continued)

FOREIGN PATENT DOCUMENTS

| | | | |
|---|---|---|---|
| CN | 1421101 | A | 5/2003 |
| CN | 1946159 | A | 4/2007 |

(Continued)

OTHER PUBLICATIONS

S.J. Shellhammer et al., "Technical Challenges for Cognitive Radio in the TV White Space Spectrum," Information Theory and Applii-iiions Workshop, 2009, Feb. 2009.

(Continued)

*Primary Examiner* — Phirin Sam
(74) *Attorney, Agent, or Firm* — Kevin T. Cheatham

(57) ABSTRACT

In general, this disclosure relates to techniques for transmitting data using one or more identified channels of a spectrum. One example method comprises identifying, with a first communication device, at least one channel currently available in a digital broadcast spectrum, and receiving, with the first communication device, data sent from a second communication device. The method further comprises transmitting the data from the first communication device in the at least one identified channel of the digital broadcast spectrum, wherein the transmitted data complies with a digital broadcast format.

66 Claims, 13 Drawing Sheets

(56) References Cited

U.S. PATENT DOCUMENTS

| | | | | |
|---|---|---|---|---|
| 2006/0193286 | A1 | 8/2006 | Naghian et al. | |
| 2007/0039025 | A1* | 2/2007 | Kraft et al. | 725/62 |
| 2007/0143816 | A1* | 6/2007 | Gupta et al. | 725/135 |
| 2007/0207782 | A1* | 9/2007 | Tran | 455/414.1 |
| 2007/0256108 | A1 | 11/2007 | Du Val et al. | |
| 2008/0022352 | A1* | 1/2008 | Seo et al. | 725/142 |
| 2008/0025211 | A1* | 1/2008 | Karaoguz et al. | 370/229 |
| 2008/0066097 | A1* | 3/2008 | Park et al. | 725/32 |
| 2008/0086286 | A1 | 4/2008 | Shellhammer | |
| 2008/0165754 | A1 | 7/2008 | Hu | |
| 2009/0169178 | A1* | 7/2009 | Higgins et al. | 386/124 |
| 2009/0193458 | A1 | 7/2009 | Finseth et al. | |
| 2009/0248828 | A1* | 10/2009 | Gould et al. | 709/207 |
| 2009/0270025 | A1 | 10/2009 | Kossi et al. | |
| 2010/0025561 | A1 | 2/2010 | Becker | |
| 2010/0048234 | A1 | 2/2010 | Singh | |
| 2010/0062793 | A1 | 3/2010 | Sun et al. | |
| 2010/0081449 | A1 | 4/2010 | Chaudhri et al. | |
| 2010/0106797 | A1* | 4/2010 | Nagaraja | 709/217 |
| 2010/0144357 | A1 | 6/2010 | Chaudhri et al. | |
| 2010/0146537 | A1* | 6/2010 | Paik et al. | 725/28 |
| 2010/0195667 | A1 | 8/2010 | Wang et al. | |
| 2010/0325666 | A1 | 12/2010 | Wiser et al. | |
| 2011/0199931 | A1* | 8/2011 | Anderson et al. | 370/252 |

FOREIGN PATENT DOCUMENTS

| | | | |
|---|---|---|---|
| CN | 101346914 | A | 1/2009 |
| JP | 2000196967 | A | 7/2000 |
| JP | 2004523966 | A | 8/2004 |
| JP | 2005197829 | A | 7/2005 |
| JP | 2006157362 | A | 6/2006 |
| JP | 2006165934 | A | 6/2006 |
| JP | 2006522545 | A | 9/2006 |
| JP | 2007019978 | A | 1/2007 |
| JP | 2007134896 | A | 5/2007 |
| JP | 2008060761 | A | 3/2008 |
| JP | 2008199111 | A | 8/2008 |
| JP | 2008263531 | A | 10/2008 |
| JP | 2009141497 | A | 6/2009 |
| JP | 2009159470 | A | 7/2009 |
| TW | 200826581 | A | 6/2008 |
| WO | 2004082279 | A1 | 9/2004 |
| WO | 2008086243 | | 7/2008 |
| WO | WO2008086243 | | 7/2008 |
| WO | WO2008155598 | A1 | 12/2008 |

OTHER PUBLICATIONS

Y. Hur et al., "A Cognitive Radio (CR)-based Mobile Interactive Digital Broadcasting Application adopting a Multi-Resolution Spectrum-Sensing (MRSS) Technique," IEEE, 5 pages, 2007.

Federal Communications Commission, "Second Report and Order and Memorandum Opinion and Order," Released Nov. 14, 2008, 130 pages, FCC 08-260, Washington, D.C., 20554.

International Search Report & Written Opinion—PCT/US2010/042345, International Search Authority—European Patent Office—Oct. 21, 2010.

S.J. Shellhammer et al., "Technicai Challenges for Cognitive Radio in the TV White Space Spectrum," Information Theory and Applications Workshop, 2009, Feb. 2009.

Y, Hur et al., "A Cognitive Radio (CR)-based Mobile Interactive Digital Broadcasting Application adopting a Multi-Resolution Spectrum-Sensing (MRSS) Technique," IEEE, 5 pages, 2007.

Federal Communications Commission, FCC 08-260, "In the Matter of Unlicensed Operation in the TV Broadcast Bands, Additional Spectrum for Unlicensed Devices Below 900 MHz and in the 3 GHz Band," Second Report and Order and Memorandum Opinion and Order, released Nov. 14, 2008.

Rajamani, et al., Control Link for Wireless Display Unit, U.S. Appl. No. 12/611,798, filed Nov. 3, 2009.

International Preliminary Report on Patentability—PCT/US2010/042345, The International Bureau of WIPO—Geneva, Switzerland, Oct. 5, 2011.

Taiwan Search Report—TW099123668—TIPO—May 9, 2013.

Taiwan Search Report—TW099123668—TIPO —Oct. 1, 2013.

* cited by examiner

WIRELESS TRANSMISSION OF DATA USING AN AVAILABLE CHANNEL OF A SPECTRUM

This application is a continuation-in-part of U.S. application Ser. No. 12/547,834, filed on Aug. 26, 2009, the entire content of which is incorporated herein by reference. This application also claims the benefit of U.S. Provisional Application 61/226,608 filed on Jul. 17, 2009, and U.S. Provisional Application 61/295,495 filed on Jan. 15, 2010, the entire content of each of which is incorporated herein by reference.

TECHNICAL FIELD

This disclosure relates to the transmission of data in a network.

BACKGROUND

Presently, several solutions for the wireless display of multimedia data, such as wireless HDMI (High-Definition Multimedia Interface), are in development. The primary intent for these solutions is to replace the HDMI cable between a particular component (e.g., set-top box, digital versatile disc (DVD) player, computing device) and a display device.

Some providers have developed solutions that use proprietary methodologies for the transmission of uncompressed video. Other solutions may target consumer electronic devices (e.g., game consoles or DVD players) and require dedicated hardware on both the host and client side. The power consumption for such dedicated devices may be quite high. In addition, the transmission of uncompressed video in some solutions may limit any expansion capabilities to support higher-resolution data transmission. Some technologies provide wireless display extensions for mobile communication devices over local wireless networks (e.g., Wi-Fi) to enable general purpose display-extension capabilities.

SUMMARY

In general, this disclosure relates to techniques for transmitting data using one or more identified channels of a spectrum. Some techniques may facilitate the wireless transmission of data, received from a communication device, to one or more other receiving devices, such as a data receiver and/or television. In various instances, these techniques may be implemented by a stand-alone device that is wirelessly coupled both to a source communication device, which provides the source data, and to other receiving devices. In some cases, the stand-alone device may perform transcoding operations to convert data from a first format to another format that is readily usable by the receiving devices.

An example method may comprise identifying, with a first communication device, at least one channel currently available in a digital broadcast spectrum, and receiving, with the first communication device, data sent from a second communication device. The method further comprises transmitting the data from the first communication device in the at least one identified channel of the digital broadcast spectrum, wherein the transmitted data complies with a digital broadcast format.

An example communication device may comprise one or more processors, a channel identifier, a receiver, and a transmitter. The channel identifier is operable by the one or more processors to identify at least one channel currently available in a digital broadcast spectrum. The receiver is operable by the one or more processors to receive data sent from a second communication device. The transmitter is operable by the one or more processors to transmit the data in the at least one identified channel of the digital broadcast spectrum, wherein the transmitted data complies with a digital broadcast format.

An example computer-readable storage medium comprises instructions for causing one or more processors of a communication device to identify at least one channel currently available in a digital broadcast spectrum, receive data sent from a second communication device, and transmit the data in the at least one identified channel of the digital broadcast spectrum, wherein the transmitted data complies with a digital broadcast format.

The techniques described in this disclosure may be implemented in hardware, software, firmware, or any combination thereof. For example, various techniques may be implemented or executed by one or more processors. As used herein, a processor may refer to a microprocessor, an application specific integrated circuit (ASIC), a field programmable gate array (FPGA), a digital signal processor (DSP), or other equivalent integrated or discrete logic circuitry. Software may be executed by one or more processors. Software comprising instructions to execute the techniques may be initially stored in a computer-readable medium and loaded and executed by a processor.

Accordingly, this disclosure also contemplates computer-readable storage multimedia comprising instructions to cause a processor to perform any of a variety of techniques as described in this disclosure. In some cases, the computer-readable storage medium may form part of a computer program storage product, which may be sold to manufacturers and/or used in a device. The computer program product may include the computer-readable medium, and in some cases, may also include packaging materials.

The details of one or more aspects are set forth in the accompanying drawings and the description below. Other features, objects, and advantages will be apparent from the description and drawings, and from the claims.

DETAILED DESCRIPTION

Figure 1:
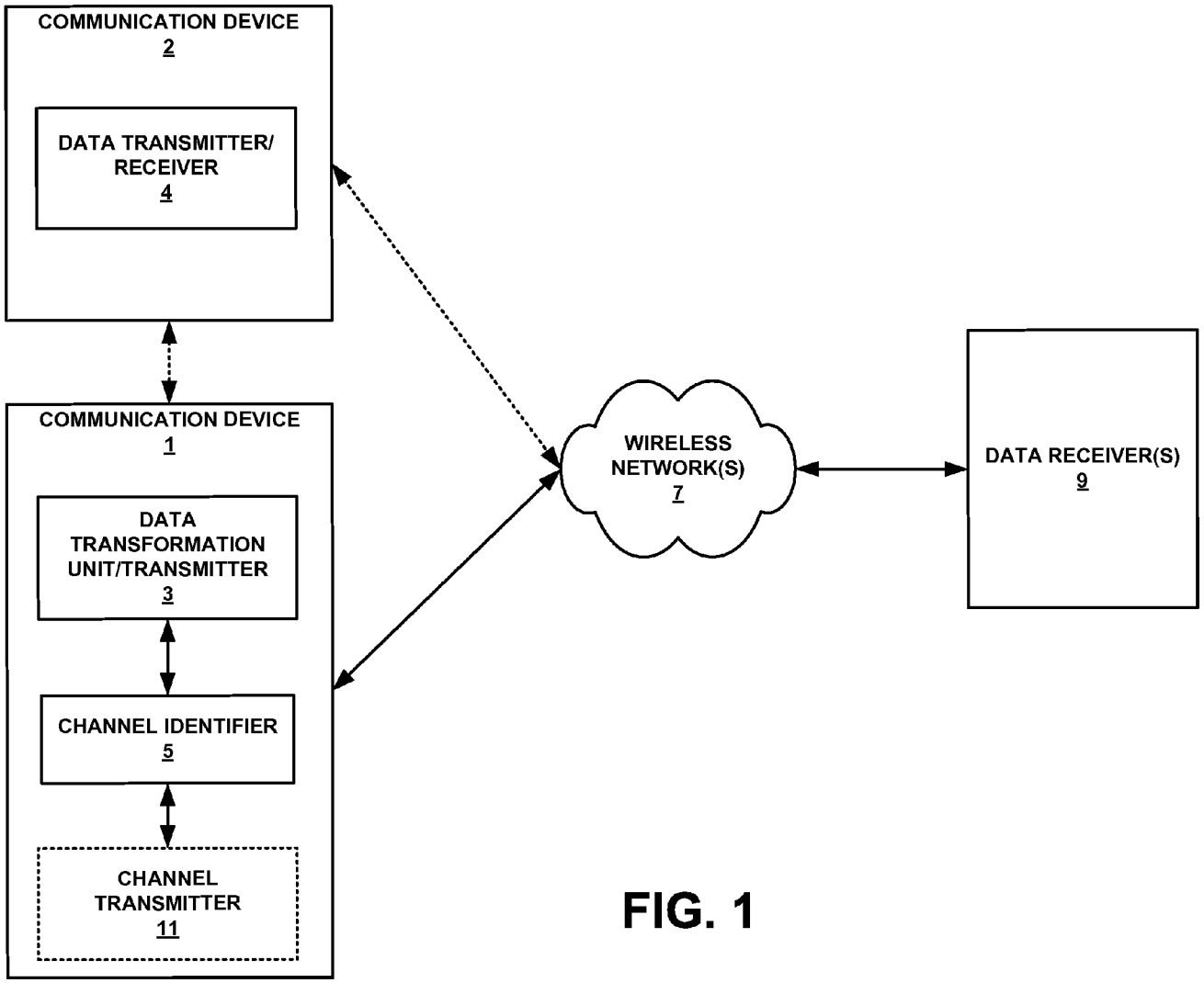
FIG. 1 is a block diagram illustrating an example of multiple communication devices and one or more data receivers that are capable of wireless communication.

FIG. 1 is a block diagram illustrating an example of multiple communication devices 1, 2 and one or more data receivers 9 that are capable of wireless communication via one or more wireless networks 7. Communication device 1 is capable of receiving data from communication device 2 and sending data to data receivers 9. In some cases, the data may comprise multimedia data including at least one of audio data, video data, text data, speech data, and graphics data.

In some instances, wireless networks 7 may comprise a network providing support for communications via a wireless local area network (WLAN), such as communications via Wi-Fi (Institute of Electrical and Electronics Engineers (IEEE) 802.11 standards). In some instances, wireless networks 7 may comprise a network providing support for communications via a wireless personal area network (WPAN), such as communications via Bluetooth®. In some cases, wireless networks 7 may comprise a network providing support for communications across a digital broadcast spectrum for a digital broadcast format, such as an Advanced Television Systems Committee (ATSC) format (which may include an ATSC M/H (ATSC Mobile/Handheld) format), a Digital Video Broadcasting (DVB) format, a Terrestrial Digital Multimedia Broadcasting (T-DMB) format, an Integrated Services Digital Broadcasting Terrestrial (ISDB-T) format, or a Moving Picture Experts Group Transport Stream (MPEG-TS) format, provided by International Standard ISO/IEC (International Electrotechnical Commission) 13818-1, to name only a few, as will be described in more detail below. ATSC standards are a set of standards developed by the Advanced Television Systems Committee for digital television transmission. ATSC M/H standards are a set of standards developed by the Advanced Television Systems Committee for mobile television transmission. As used herein, "ATSC" includes and refers to any ATSC-related standards, including ATSC standards for digital television (DTV) and/or ATSC M/H standards. DVB standards are a suite of internationally accepted, open standards for digital television, and are published by a Joint Technical Committee (JTC) of European Telecommunications Standards Institute (ETSI), European Committee for Electrotechnical Standardization (CENELEC), and European Broadcasting Union (EBU). DMB is a digital radio transmission technology for sending multimedia data to mobile devices. ISDB is a Japanese standard for digital television and digital radio.

A digital broadcast format may be a broadcast format in which no specific or particular destination is provided in or specified by the transmitted data. For example, a digital broadcast format may comprise a format in which the header of a broadcasted data packet or unit does not include any destination address.

In some cases, wireless networks 7 may further provide support for other wireless communications, such as infrared or other radio frequency communications. These wireless communications may allow communication device 1 to provide channel information to data receivers 9.

In some examples, communication device 2 is capable or wirelessly communicating with communication device 1 via wireless networks 7, where communication device 2 communicates with wireless networks 7 (e.g., dotted line in FIG. 1 between communication device 2 and wireless networks 7). However, in other examples, communication device 1 or communication device 2 may be docked or otherwise coupled with respect to the other, in which case these devices may have direct communication without the use of wireless networks 7 (e.g., dotted line in FIG. 1 between communication device 2 and communication device 1).

Communication device 1 may comprise a fixed system of one or more devices, which transmits or receives data at a specified location, or a mobile system of one or more devices. Each device may comprise one or more processors. Communication device 1 may comprise one or more stand-alone devices or may be part of a larger system. For example, communication device 1 may comprise one or more peripheral devices (e.g., keyboard, mouse), including peripheral devices and/or accessories to portable devices that communicate wirelessly with other devices. Communication device 1 may also comprise, or be included within, a media server that is capable of disturbing media data to multiple different devices, such as data receivers 9. In some cases, communication device 1 may include components that are included within one or more integrated circuits, or chips, which may be used in some or all of the devices described above.

Communication device 1 is capable of wirelessly communicating with communication device 2 via wireless networks 7. For instance, communication device 1 may receive data that is transmitted by a data transmitter/receiver 4 of communication device 2. Communication device 2 may also comprise a fixed system of one or more devices, which transmits or receives data at a specified location, or a mobile system of one or more devices. Each device may comprise one or more processors. Communication device 2 may comprise, or be part of, a wireless communication device (e.g., wireless mobile handset or device), a digital camera, digital television (TV), a video camera, a video telephone, a digital multimedia player, a personal digital assistant (PDA), a video game console, a personal computer or laptop device, a smartbook/smartphone, or other video device. In some cases, communication device 2 may include components that are included within one or more integrated circuits, or chips, which may be used in some or all of the devices described above.

In certain examples, communication system 1 may be used for video game or gaming applications. In these examples, one or more users of communication system 1 may play one or more games, including any interactive applications with other users via a network connection (e.g., wireless network connection) to communication system 1. Graphics and/or video data for the games, including real-time information, may be provided to data receivers 9, which may then be displayed on a separate display device coupled to data receivers 9 (e.g., a high-definition television or display device). In this fashion, a user may view the display data for a game application on this separate display device.

As shown in FIG. 1, communication device 1 may include a data transformation unit/transmitter 3, which is coupled to a channel identifier 5. Communication device 1 is capable of receiving, processing, and generating data. For example, communication device 1 may receive data (e.g., from communication device 2) over any of many possible radio or access networks, including cellular, local and/or personal wireless (e.g., Wi-Fi, Bluetooth®), or broadcast networks, including for example, ATSC, DVB, ISDB-T, or T-DMB. In some instances, communication device 1 may receive data over a wired interface or via one or more embedded interfaces. The data may also comprise data in an uncompressed format, such as data received via image/video sensors for camera or other camcorder applications. In some examples, the data may include one or more of audio data, video data, graphics data, text data, speech data, or metadata.

In some examples, communication device 1 may receive data from communication device 2 via a wireless local area network, which may be one of wireless networks 7. For example, in some specific scenarios, communication device 1 and communication device 2 may exchange information via any WLAN (e.g., Wi-Fi) protocol or WPAN (e.g., Bluetooth®) protocol.

Communication device 1 is further capable of broadcasting or otherwise transmitting data to one or more other devices, such as data receivers 9, through wireless networks 7. Data transformation unit/transmitter 3 is capable of transforming data into a particular digital broadcast format. For example, data transformation unit/transmitter 3 may be capable of encoding data into a format that complies with a particular digital broadcast format (e.g., ATSC, DVB, ISDB-T, T-DMB, MPEG-TS), modulating and then transmitting the data.

Channel identifier 5 is able to identify at least one available channel of a spectrum, where one or more devices of communication device 1 may be involved in the identification of the at least one available channel. For example, the identification of the at least one available channel may be initiated by one or more devices of communication device 1. In some instances, channel identifier 5 may identify the at least one available channel in an unused and/or unlicensed portion of a digital broadcast spectrum, such as a digital television broadcast spectrum. In some instances, the at least one available channel may comprise television band white space. As specified in the "Second Report and Order and Memorandum Opinion and Order" adopted by the Federal Communications Commission (FCC) on Nov. 4, 2008, and released on Nov. 14, 2008 as FCC Order 08-260, "white space" may comprise unused portions or locations of a broadcast television spectrum that are not currently being used by licensed services, and which therefore may be used by unlicensed radio transmitters.

In some instances, an available channel may comprise a channel that is currently unoccupied. In one example, an available channel may comprise a channel that is not currently being used by any authorized or licensed users, e.g., users licensed by the FCC. In one example, an available channel may comprise a channel that is not currently being used either by licensed users or by unlicensed users, e.g., other white space channel users. In some cases, an available channel may comprise a channel that may be used by a user upon acquiring a secondary license from another licensed user.

Upon identification of the one or more available channels, transformation unit/transmitter 3 may transmit data to data receivers 9 via wireless networks 7, using the at least one identified available channel. In some cases, communication device 1 will perform one or more of the above-described actions, either automatically or via user input, based upon the execution of one or more services or applications locally running within communication device 1 or communication device 2. Data receivers 9 may include functionality for demodulating and/or decoding the received broadcast data from communication device 1.

As described above, channel identifier 5 is able to identify at least one available channel currently available in a digital broadcast spectrum for the particular digital broadcast format. In one example, channel identifier 5 may include a spectrum sensor that is used to identify the at least one available channel by sensing signal information within one or more channel ranges, or bands, within the digital broadcast spectrum. In one example, channel identifier 5 may access a database (e.g., a digital TV bands database, such as the one shown in FIG. 6) to identify the at least one available channel that is currently available.

For instance, communication device 1 may include geolocation functionality, whereby communication device 1 is capable of determining its geographic location, e.g., by using a Global Positioning System (GPS) or other similar component, pilot signal or other location techniques including) (Internet Protocol) address based location look up services. In this instance, communication device 1 may provide such location information to a digital TV bands database. The digital TV bands database may be populated with channel information based upon location, and may be able to provide communication device 1 with a list of any available channels within the geographic region currently occupied by communication device 1.

In some examples, communication device 1 may be capable of determining its geographic location via location estimation using an Internet Protocol (IP) address of communication device 1. Geo-location by IP address is a technique of determining a geographic latitude, longitude, and also potentially city and state of communication device 1 by comparing public IP address of communication device 1 with IP addresses of other electronically neighboring servers, routers, or other devices having known locations. In these examples, communication device 1 may provide its IP address to an external server (e.g., via wireless communication). The external server may access a database containing IP addresses of other devices having known locations. The external server may use techniques to obtain an estimate of the location of communication device 1 by comparing the IP address of communication device 1 to the IP addresses of the devices having known locations within the database, and may then provide this estimated location back to communication device 1. The external server may, in some cases, perform the comparison by determining which devices within the database have IP addresses that most closely match or resemble the IP address of communication device 1.

Channel identifier 5 may automatically select one or more of the identified available channels for use by data transformation unit/transmitter 3. In some cases, communication device 1 may provide a list of the identified available channels to communication device 2. A user or application of communication device 2 may then select one or more of the available channels, and communication device 2 may then sent the channel selection(s) back to communication device 1. In some instances, an application executing on communication device 2 may request multiple available channels. For example, the application may wish to send the same program content or data to multiple different ones of data receivers 9 across different channels. In some cases, the application may wish to send different program content or data to the same one of data receivers 9 across different channels. These are just a few example instances in which multiple ones of the available channels may be selected by communication device 2.

As shown in FIG. 1, communication device 1 may optionally include a channel transmitter 11. Communication device 1 is capable of transmitting data over an unused portion of a digital broadcast spectrum, and switching from one transmission channel to another. For example, communication device 1 may utilize an identified, available channel in an unused portion of a spectrum, and transmit data using this available channel via wireless networks 7 to data receivers 9. In some instances, communication device 1 may need to vacate a particular channel upon subsequent detection of use of the channel by a licensed user. In these instances, communication device 1 may need to identify a different available channel for use in transmitting further data to data receivers 9. In such instances, channel transmitter 11 is capable of transmitting channel change information to data receivers 9 via communication over wireless networks 7.

For example, channel identifier 5 may identify a first channel at a first point in time that is available for use by communication device 1 to transmit data. Channel transmitter 11 may send information to data receivers 9, via wireless network 7, which allows data receivers 9 to determine or identify the first channel. For instance, channel transmitter 11 may send information that directly specifies the first channel or otherwise allows data receivers 9 to determine the first channel based upon the received information.

At a later point in time, channel identifier 5 may determine that the first channel is no longer available for use by communication device 1. For example, if another user (e.g., licensed user) has taken over occupancy of the first channel, or if the first channel otherwise becomes unavailable, channel identifier 5 may need to identify a second, different channel that is currently available for use by communication device 1 in sending subsequent data via wireless networks 7. Upon identification of such a second channel, channel transmitter 11 is capable of transmitting information via wireless networks 7 that allows data receivers 9 to determine or identify the new, second channel. Data receivers 9 are then capable of receiving data transmissions from communication device 1 over the second channel.

In order to make the channel change with minimal interruption (e.g., to the listening and/or viewing experience of the user), a closed loop control mechanism or protocol may be utilized. Such a control mechanism may comprise a communication protocol between channel transmitter 11 and data receivers 9 via wireless networks 7. For example, channel transmitter 11 may utilize an infrared (IR) or radio frequency (RF) communication to transmit channel change information to data receivers 9 via wireless networks 7, such that data receivers 9 may efficiently change channels with minimal interruption to end users of devices (e.g., display devices) that be included within or otherwise coupled to data receivers 9. In some cases, data transformation unit/transmitter 3 may send redundant information across both a previously used channel and a newly selected channel to reduce or eliminate disruption or impact of data flow processed by data receivers 9.

In some examples, channel transmitter 11 may comprise a low power, low cost infrared transmitter that may be embedded within a portable device included within communication device 1. The transmit power of channel transmitter may be configurable and may also be user programmable. For example, channel transmitter 11 may not be in a line-of-sight with the receiver. In this case, if channel transmitter 11 comprises an infrared based transmitter, a higher output power of channel transmitter 11 may enable the light to bounce off of obstacles to reach data receivers 9 and close the loop. Alternatively, if channel transmitter comprises an IR-based transmitter, channel transmitter 11 may have a reflector, potentially directed towards data receivers 9.

Channel transmitter 11 is not limited, however, to provide IR-based communication. For example, channel transmitter 11 may provide any number of radio frequency or wireless communications via wireless network/communications 7 to data receivers 9. For example, channel transmitter 11 may implement Bluetooth®, ZigBee®, ultra wide band (UWB), wireless personal area network (WPAN), or other low power, wireless RF protocols as an alternative to or in addition to IR. Hence, channel transmitter 11 could utilize IR communication, RF communication, or a combination of both for transmitting channel information.

In one aspect, communication device 1 is capable of receiving data from communication device 2. Channel identifier 5 of communication device 1 may identify at least one channel of a spectrum, such as a spectrum in one of wireless networks 7. Data transformation unit/transmitter 3 may then transmit the data in the at least one identified channel of the spectrum. For example, data transformation unit/transmitter 3 may broadcast the data, via wireless networks 7, to data receivers 9.

Communication device 2 may send data to communication device 1 in a first data format. Communication device 1 may then send this data in the at least one identified channel in a second data format. The first data format may or may not be the same as the second data format. For example, if the first data format is the same as the second data format, communication device 1 may not necessarily alter the data prior to its transmission or broadcast to data receivers 9. On the other hand, if the first data format is different from the second data format, communication device 1 may encode or transcode the data prior to transmitting it to data receivers 9, as will be described further below. In some examples, communication device 1 may receive data sent from communication device 2 in a digital broadcast format, and communication device 1 may broadcast or otherwise transmit data via wireless networks 7 to data receivers 9 in the digital broadcast format.

In some examples, communication device 1 may be docked or otherwise directly coupled to communication device 2. In other examples, communication device 1 and communication device 2 may communicate using a first wireless protocol (e.g., WLAN, WPAN protocol) via wireless networks 7. Communication device 1 may transmit data to data receivers 9, however, using a different protocol or standard. For instance, communication device 1 may broadcast data according to a digital broadcast format via wireless networks 7, such as a digital television broadcast format (e.g., ATSC). Wireless networks 7, therefore, may comprise multiple different network types support varying communication standards or protocols. In some instances, communication device 2 and communication device 1 may communicate over a first wireless network (e.g., WLAN, WPAN), and communication device 1 may communicate with data receivers 9 over a second, different wireless network (e.g., digital broadcast network), where each of the first and second wireless networks included in wireless networks 7. As a result, communication device 2 may take advantage of the broadcast communication capabilities of communication device 1 to data receivers 9, without necessarily including any such capabilities or functionality within communication device 2. Instead, communication device 2 is capable of either directly or wirelessly communicating with communication device 1 over wireless (e.g., WLAN, WPAN) communication, and then allowing communication device 1 to handle broadcast communications to data receivers 9.

The data sent from communication device 2 may include display information of communication device 2. The display information may include primary display data that is rendered on communication device 2. For example, the primary display data may include any data that is displayed on a display of communication device 2 (e.g., on a screen of a mobile device). Communication device 1 may then transmit the data from communication device 1 in the at least one identified channel by transmitting the primary display data to data receivers 9 for purposes of display (e.g., on a display coupled to data receivers 9, such as on a display of a digital television).

In some instances, however, transmitting the data from communication device 1 in the at least one identified channel may include transmitting secondary display data that is different from primary display data displayed on communication device 2. Communication device 1 may receive display information from communication device 2 that includes the secondary display data which is not actually displayed on communication device 2. However, the secondary display data may be displayed on a display coupled to data receivers 9. For instance, this may occur when a user of communication device 2 may want to look at content (e.g., web pages, desktop information) that may not entirely fit on a display screen of communication device 2.

In some examples, the display data sent by communication device 2 to communication device 1 may include both primary display data that may be displayed by communication device 2 and also secondary display data that is different from the primary display data, where the secondary display data is not displayed on communication device 2 (e.g., if the secondary display data does not fit on the display screen provided by communication device 2). In these examples, communication device 1 may transmit the primary display data and/or the secondary display data to data receivers 9 for purposes of display. For instance, if data receivers 9 are coupled to a display screen that is larger than the display screen provided by communication device 2, the display screen coupled to data receivers 9 may be capable of displaying a larger amount of data, such as, for instance, by displaying the secondary display data. The display screen coupled to data receivers 9 may also be configured to display the primary display data.

In some examples, the data sent from communication device 2 may include data provided by a human interface device (e.g., touch-based device, such as a touch screen) of communication device 2. Communication device 1 may transmit the data provided by the human interface device to data receivers 9, wherein the data provided by the human interface device is capable of being used by data receivers 9 to control an icon (e.g., cursor) that is displayed by a display screen coupled to data receivers 9. For instance, a touch screen of communication device 2 could be used as, for example, a touch pad to control a cursor or other icon on the display of the data receivers 9.

Figure 2:
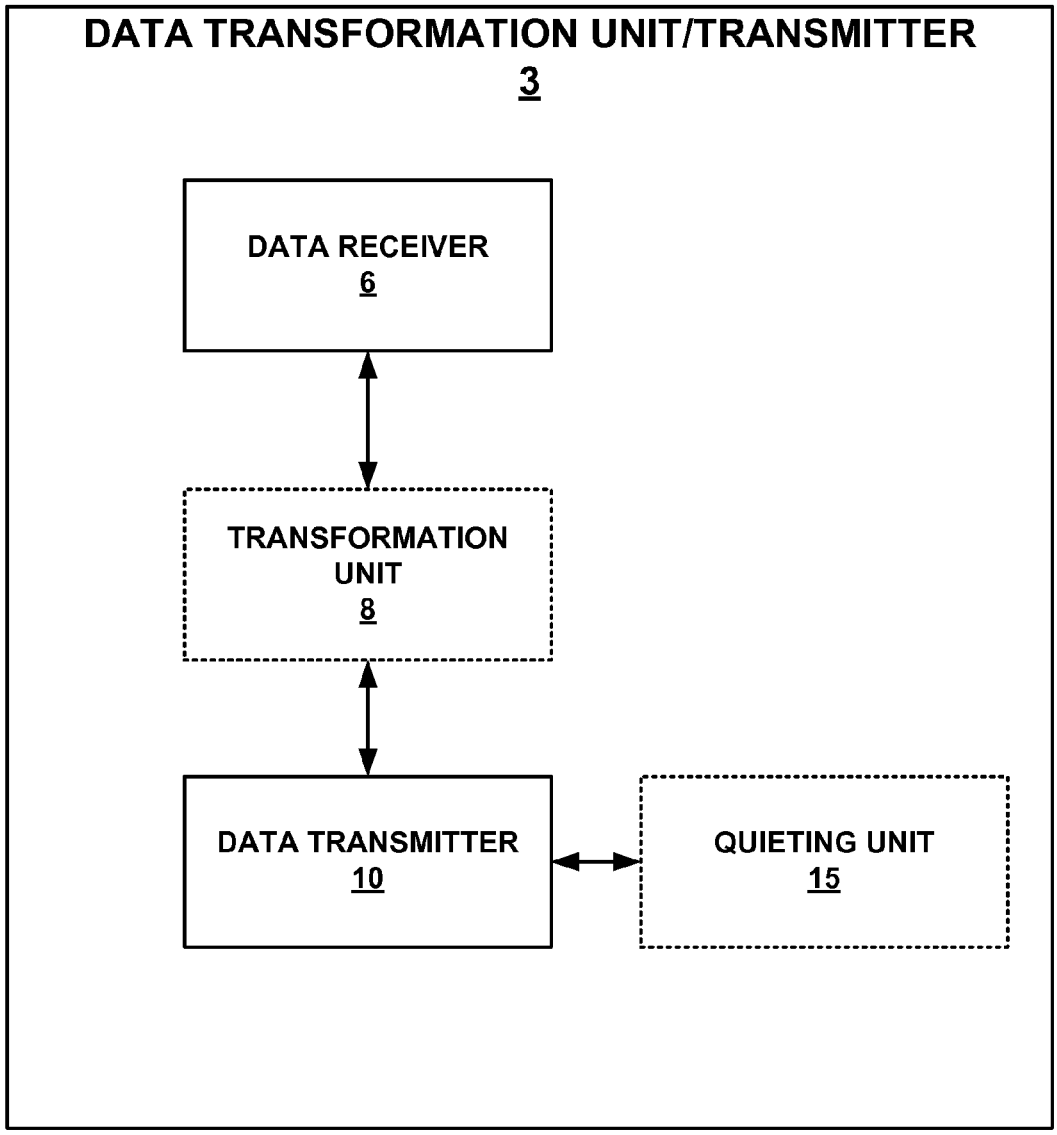
FIG. 2 is a block diagram illustrating an example of further details of a data transformation unit/transmitter that may be included within one of the communication devices shown in FIG. 1.

FIG. 2 is a block diagram illustrating an example of further details of data transformation unit/transmitter 3 shown in FIG. 1. Data transformation unit/transmitter 3 may be part of communication device 2. As shown in FIG. 2, data transformation unit/transmitter 3 may include a data receiver 6 and a data transmitter. Data transformation unit/transmitter 3 may also optionally include a transformation unit 8 and a quieting unit 15.

Data receiver 6 is capable of receiving data from one or more sources. For example, data receiver 6 may receive data (e.g., from communication device 2) over any of many possible radio or access networks, including cellular, local wireless (e.g., Wi-Fi, Bluetooth®), or broadcast networks, including for example, ATSC, DVB, ISDB-T, or T-DMB. Data transmitter is capable of transmitting data from data transformation unit/transmitter 3. Data transmitter 3 is able to send data over any of many possible radio or access networks, including cellular, local wireless (e.g., Wi-Fi, Bluetooth®), or broadcast networks, including for example, ATSC, DVB, ISDB-T, or T-DMB.

In situations in which data transformation unit/transmitter 3 may need to transform any received data into a different format prior to sending such data to a data receiver, transformation unit 8 may perform such transformation operations. As will be described in more detail below, transformation unit 8 may perform encoding and/or transcoding operations. For example, if communication device 1 receives data of a first format (e.g., Moving Picture Experts Group (MPEG) 4 Part 2) but sends data of a second format (e.g., MPEG-2) to a data receiver, transformation unit 8 may perform one or more transcoding functions to transcode the data of the first format into data of the second format.

Quieting unit 15 is capable of providing transmission quieting intervals during spectrum sensing operations. For instance, if channel identifier 5 (FIG. 1) includes spectrum sensing functionality, quieting unit 15 may provide quiet time intervals. During such time intervals, data transformation unit/transmitter 3 may refrain from transmitting data to data receivers 9 via wireless networks 7. For example, data transformation unit/transmitter 3 may refrain from transmitting data, such as by temporarily disabling or even temporarily turning off its data transmission functions. In one example, channel identifier 5 may detect, during at least one time interval, whether at least one channel of a spectrum, (e.g., white space channel), is available for use. During this at least one time interval, quieting unit 15 may cause data transmitter 10 to refrain from transmitting any data to data receivers 9 (e.g., by temporarily disabling or turning off data transmitter 10), which may reduce potential interference between data transmission and spectrum sensing operations. Although shown as a separate optional component in FIG. 2, quieting unit 15 may, in some example cases, be included within data transmitter 10.

Figure 3:
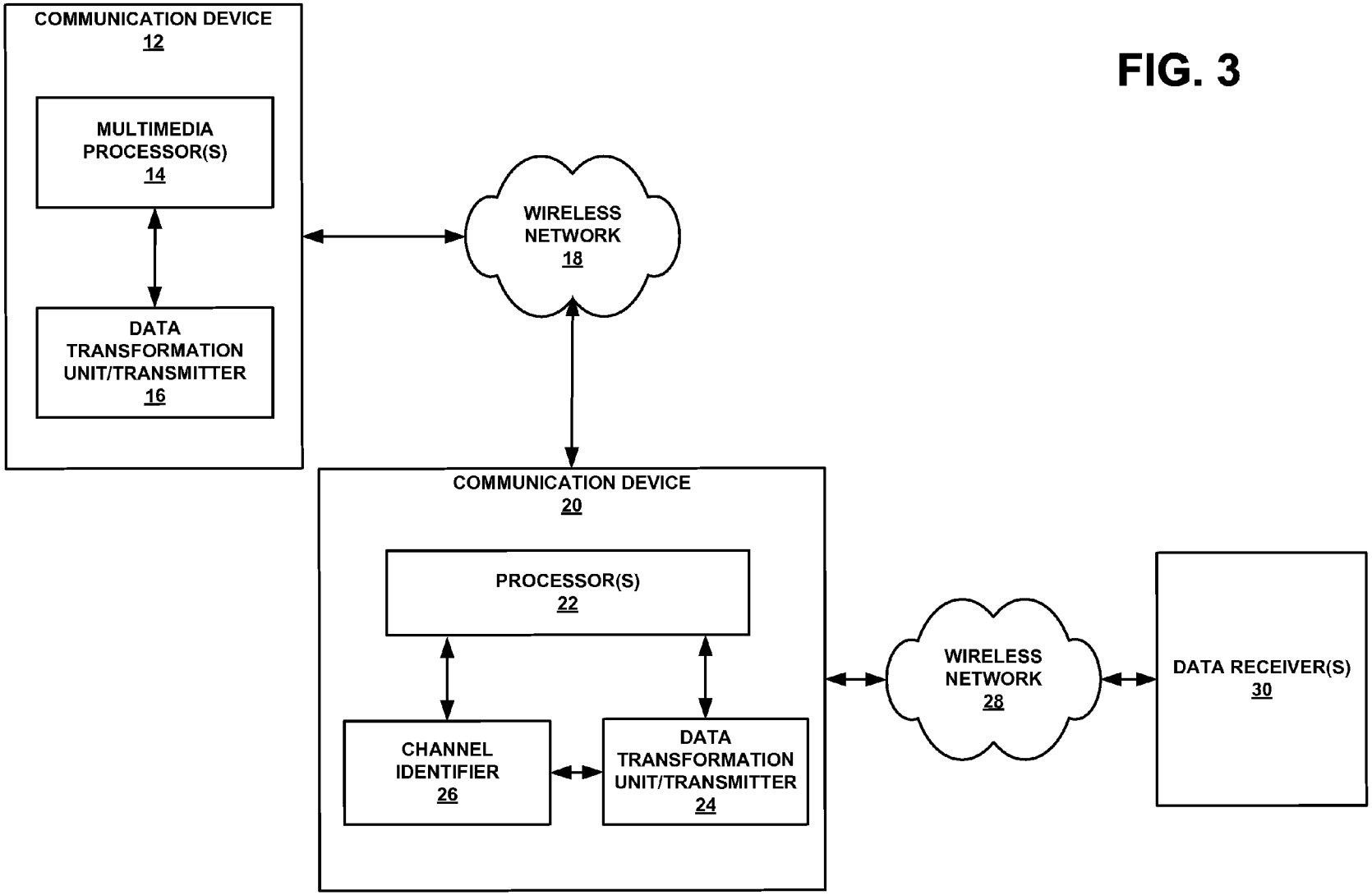
FIG. 3 is a block diagram illustrating an example of a first communication device that communicates with a second communication device via a wireless network, where the second communication device communicates with one or more data receivers via a wireless network.

FIG. 3 is a block diagram illustrating an example of a first communication device 12 that communicates with a second communication device 20 via a wireless network 18, where the second communication device 20 communicates with one or more data receivers 30 via a wireless network 28. Communication device 12 is capable of sending data (e.g., multimedia data) communication device 20. In some cases, the data may comprise multimedia data including at least one of audio data, video data, text data, speech data, graphics data, and ancillary interactivity data.

Communication device 12, similar to communication device 2 of FIG. 1, may comprise a fixed system of one or more devices, which transmits or receives data at a specified location, or a mobile system of one or more devices. Each device may comprise one or more processors. Communication device 12 may comprise, or be part of, a wireless communication device (e.g., wireless mobile handset or device), a digital camera, digital television (TV), a video camera, a video telephone, a digital multimedia player, a personal digital assistant (PDA), a video game console, a personal computer or laptop device, a smartbook/smartphone, or other video device. In some cases, communication device 12 may include components that are included within one or more integrated circuits, or chips, which may be used in some or all of the devices described above.

As shown in FIG. 3, communication device 12 includes one or more multimedia processors 14. Multimedia processors may include one or more graphics processors (e.g., graphics processing unit), audio processors, and video processors for processing graphics data, audio data, and video data, respectively. Multimedia processors 14 may also include one or more processors that process data for output, such as a display processor or an audio output processor.

Multimedia processors 14 may provide data to data transformation unit/transmitter 16 of communication device 12. Similar to data transformation unit/transmitter 3 shown in FIG. 2, data transformation unit/transmitter 16 may include a data receiver, a data transmitter, and an optional transformation unit. If communication device 12 encodes data (e.g., audio data, video data) prior to its transmission via wireless network 18, the optional transformation unit may perform such encoding functionality. Such a transformation unit may also perform decoding functionality when communication device 12 receives encoded data from a separate device.

Communication device 20 may receive any transmitted data from communication device 12 via wireless network 18. In some instances, wireless network may comprise a wireless local network. Similar to communication device 1 of FIG. 1, communication device 20 may include a data transformation unit/transmitter 24 and a channel identifier. Data transformation unit/transmitter 24 may be similar to data transformation unit/transmitter 3, and channel identifier 26 may be similar to channel identifier 5. Data transformation unit/transmitter 24 and channel identifier 26 may be executed by or implemented in one or more processors 22. Communication device 20 is capable of transmitting data via wireless network 28 to one or more data receivers 30. Wireless network 28 may comprise a digital broadcast network, such as a digital television broadcast network, in some examples. Though not shown in FIG. 3, communication device 20 may also optionally include a channel transmitter (not shown), which may function similarly to channel transmitter 11 shown in FIG. 1.

In the example of FIG. 3, wireless network 18 may be different form wireless network 28. Thus, communication device 12 may send data to communication device 20 via wireless network 18, while communication device 20 may send data to data receivers 30 via a different wireless network 28.

Communication device 12 may send data to communication device 20 in a first data format. Communication device 20 may then send this data in the at least one identified channel in a second data format. The first data format may or may not be the same as the second data format. For example, if the first data format is the same as the second data format, communication device 20 may not necessarily alter the data prior to its transmission or broadcast to data receivers 30. On the other hand, if the first data format is different from the second data format, communication device 20 may encode or transcode the data prior to transmitting it to data receivers 30, as will be described further below.

In some examples, the format of data (e.g., an MPEG-4 format) exchanged between communication device 12 and communication device 20 via wireless network 18 may be different than the format of data (e.g., MPEG-2) exchanged between communication device 20 and data receivers 30 via wireless network 28. In addition, wireless network 18 maybe a different type of network than wireless network 28. As a result, communication device 20 may potentially be viewed as a bridge or interface module that receives data from communication device 12 in a first format, via one wireless network (e.g., Wi-Fi, Bluetooth®), and that then transmits the received data to data receivers in a second format via another wireless network (e.g., ATSC broadcast network).

Communication device 12, in some examples, may not necessarily need to include any functionality that is capable of providing data communications directly to data receivers 30, but may instead rely on communication device 20 in managing and controlling these communications. Any specialized functionality for these communications with data receivers 30 can be included within communication device 20 rather than communication device 12. Thus, communication device 12 may only need to include functionality that allows it to communicate, via wireless network 18, with communication device 20.

Communication device 20 may comprise a portable device that may, in some examples, serve as a peripheral/accessory device with respect to communication device 12. For example, communication device 20 may comprise a detachable/foldable keyboard, or mouse, that wirelessly communicates and is operable with communication device 12 (e.g., if communication device 12 comprise a mobile handset that may not include a keyboard or mouse).

Figure 4:
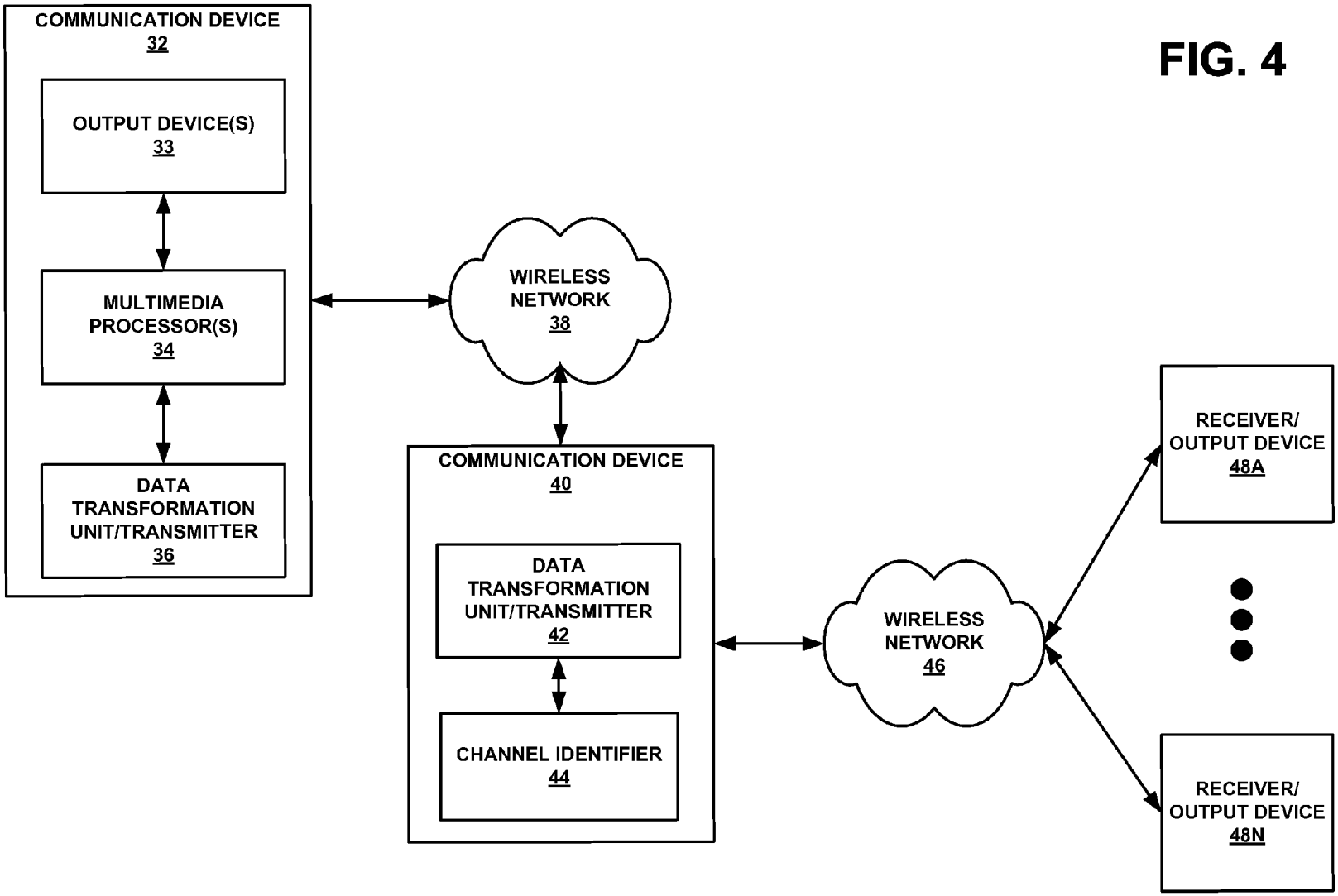
FIG. 4 is a block diagram illustrating another example of a first communication device that communicates with a second communication device via a wireless network, where the second communication device communicates with one or more data receivers/output devices via a wireless network.

FIG. 4 is a block diagram illustrating another example of a first communication device 32 that communicates with a second communication device 40 via a wireless network 38, where the second communication device 40 communicates with one or more data receivers/output devices 48A-48N via a wireless network 46. Similar to communication device 12 of FIG. 3, communication device 32 includes one or more multimedia processors 34 and a data transformation unit/transmitter 36.

In addition, communication device 32 includes one or more output devices 33 that are communicatively coupled to multimedia processors 34. Output devices 33 may include a display device and speakers. Multimedia processors 34 may provide output data to output devices 33. For example, a display processor of multimedia processors 34 may process video and/or graphics data from respective video and graphics processors within multimedia processors 34, and may provide display output to a display device within output devices 33. An audio output processor of multimedia processors 34 may provide audio output to any speakers included within output devices 33.

Similar to communication device 20 shown in FIG. 3, communication device 40 includes a data transformation unit/transmitter 42 communicatively coupled with a channel identifier 44. Data transformation unit/transmitter 42 is capable of processing and transmitting media data, via wireless network 46, to a number of external devices, such as receiver/output devices 48A-48N.

Receiver/output devices 48A-48N may each receive the data transmitted by communication device 40, and may each include a tuner that tunes in to the appropriate channel (e.g., frequency or frequency band) through which data is being broadcast from communication device 40. In some cases, receiver/output devices 48A-48N may include functionality for demodulating and/or decoding the received broadcast data from communication device 40.

In general, communication device 40 is capable of broadcasting or otherwise transmitting data to one or more of receiver/output devices 48A-48N via wireless network 46. Each of receiver/output device 48A-48N may comprise a data receiver and one or more output devices (e.g., display device). The data receiver and output devices may be distinct or integrated components. For example, if receiver/output device 48A comprises a digital television, the receiver and display device may be integrated into the digital television.

Figure 5:
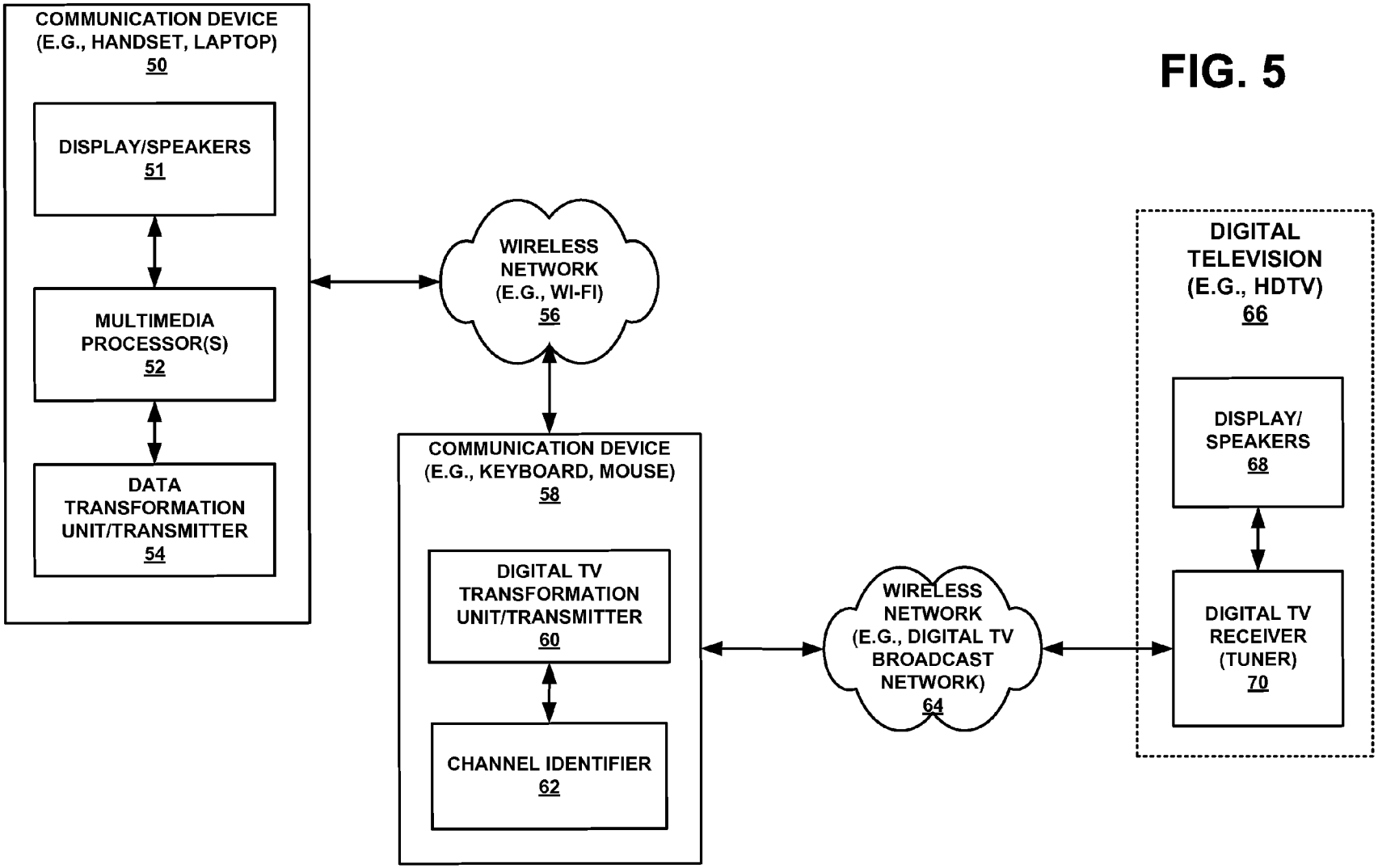
FIG. 5 is a block diagram illustrating another example of a first communication device (e.g., handset, laptop) that communicates with a second communication device via a wireless network (e.g, Wi-Fi network), where the second communication device communicates with a digital television (TV) receiver via a wireless network (e.g., ATSC broadcast network).

FIG. 5 is a block diagram illustrating another example of a first communication device (e.g., handset, laptop) 50 that communicates with a second communication device 58 via a wireless network (e.g., Wi-Fi network) 56, where the second communication device 58 communicates with a digital television (TV) receiver 70 via a wireless network (e.g., ATSC broadcast network) 64. In the example of FIG. 5, communication device 50 may function similarly to communication device 32 of FIG. 4. Communication device 50 may comprise a mobile communication device, such as a wireless communication handset (e.g., mobile telephone or PDA) or a laptop computer. In some examples, communication device 32 may comprise any form of mobile device, such as a mobile communication handset, a personal computer or laptop computer, a digital multimedia player, a personal digital assistant (PDA), a video game console, a smartbook/smartphone, or other video device.

Similar to communication device 32, communication device 50 includes one or more multimedia processors 52 communicatively coupled to a data transformation unit/transmitter 54. Multimedia processors 52 are also coupled to a display and one or more speakers 51. Display/speakers 51 may be one example of the output devices 33 shown in FIG. 4.

Communication device 50 may communicate with communication device 58 via wireless network 56. Wireless network 56 may comprise a wireless local area network, such as a network that provides support for the Wi-Fi or Bluetooth® protocols. In these instances, communication device 58 may be located in relative proximity to communication 50, such as when these devices 58, 50 are located in the same building (e.g., house) or general area. In some examples, communication device 58 may comprise a peripheral device with respect to communication device. For instance, communication device 58 may comprise a keyboard (e.g., detachable keyboard, wireless keyboard) or a mouse device (e.g., wireless mouse) that includes functionality for receiving and/or transmitting data over wireless network 56. Any communication between communication device 50 and communication device 58 may comply with a wireless communication protocol, such as Wi-Fi or Bluetooth®.

Similar to communication device 40 of FIG. 4, communication device 58 includes a data transformation unit/transmitter 60 and a channel identifier 62. In the example of FIG. 4, data transformation unit/transmitter 60 comprises a digital TV transformation unit/transmitter 60, given that this component is capable of transmitting data to one or more television devices.

Digital TV transformation unit/transmitter 60 is capable of transmitting data to digital TV receiver (tuner) 70 via wireless network 64. In some cases, wireless network 64 may comprise a digital TV broadcast network, and data transmitted by digital TV transformation unit/transmitter 60 may comply with a particular digital broadcast format (e.g., ATSC). As described previously, channel identifier 62 may identify one or more channels within wireless network 64 that are available for use. For instance, if wireless network 64 is a digital TV broadcast network (e.g., a network compliant with the ATSC standard), channel identifier 62 may identify white space within a digital broadcast spectrum that may be utilized by digital TV transformation unit/transmitter 60 to transmit data to digital TV receiver 70.

Digital TV receiver 70 is communicatively coupled to a display device and one or more speakers 68. Digital TV receiver 70 and display/speakers 68 may comprise distinct components. In some cases, digital TV receiver 70 and display/speakers 68 may be integrated and/or built in a digital TV set 66. In some cases, the digital TV 66 may comprise a high-definition TV (HDTV).

Through communication of data from communication device 50 to communication 58 via wireless network 56, and communication of data from communication device 58 to digital TV receiver 70 via wireless network 64, data that is otherwise to be displayed on display/speakers 51 of communication device 50 may be extended for display on display/speakers 68. For instance, communication device 50 may comprise a mobile handset device, in which the display screen is limited in size. In some cases, the display may comprise a Liquid Crystal Display (LCD), including a touch screen.

The display screen of display 68, however, may be much larger in size, particularly if it is included within digital TV 66, which may comprise a large-screen HDTV. This display, in some cases, may comprise a flat panel Liquid Crystal Display (LCD), a flat panel plasma display, a projection display device, a projector device, or the like. Any data that is to be displayed on a display of display/speakers 51 of communication device 50 may be also displayed on a display of display/speakers 68, which may provide a much more robust, large, and high-resolution viewing experience to an end user. Audio data from communication device 50 may also be provided for output on display/speakers 68.

To achieve this, data transformation unit/transmitter 54 of communication device 50 may transmit the data, via wireless network 56, to communication device 58, which may comprise audio data, video data, graphics data, text data, speech data, ancillary interactivity data, or other data. Communication device 58 may, in some cases, comprise a peripheral device with respect to communication device 50. In these cases, communication device may comprise a wireless peripheral device, such as a keyboard or mouse that a user may use in conjunction with communication device 50. For example, if communication device 50 comprises a mobile handset, communication device 58 may comprise a peripheral device that may be used in conjunction with the mobile handset.

Communication device 58 utilizes its channel identifier 62 to identify one or more available channels in wireless network 64, which may comprise a digital television broadcast network. Communication device 58 may then transmit the data, via wireless network 64, to digital TV receiver 70, which may then provide the data for output on display/speakers 68.

In some instances, particularly when wireless network 56 comprises a different network from wireless network 64, communication device 50 may transmit data to communication device 58 in a different data format than that use by communication device 58 in transmitting data to digital TV receiver 70. In these cases, digital TV transformation unit/transmitter 60 may transform the data it receives from communication device 50 into a different data format. For example, as will be described further below, digital TV transformation unit/transmitter 60 may encode or transcode the received data from communication device 50 prior to retransmitting it to digital TV receiver 70.

In some cases, digital TV transformation unit/transmitter 60 may transform and/or encapsulate multiple received streams of multimedia data from communication device 50 into individual single program transport streams that may be transmitted over multiple broadcast channels. In some cases, the multiple streams of multimedia data may be encapsulated in the same transport stream and transmitted in a single channel. One multimedia stream may be transmitted as a picture-in-picture (PIP) data path that includes supplemental multimedia information or metadata with respect to the multimedia data. Metadata may include, for example, one or more of text, notification messages, program guide information, or menu information.

Because communication device 58 is capable of transmitting data, via wireless network 64, in a format that may be directly processed by digital TV receiver 70, which may be embedded or otherwise part of digital TV 66, communication device 58 may function as a form of TV-adapter, providing communication device 50 with a direct interface to digital TV 66 without any additional hardware components for digital TV 66, such as, for example, a set-top box or other intermediate device used to decode any received data prior to presentation on display 68. Communication device 58 may be capable of formatting data into an appropriate format (e.g., ATSC format) that may be received and processed directly by digital TV receiver 70 to enable seamless interoperability with digital TV 66.

Figure 6:
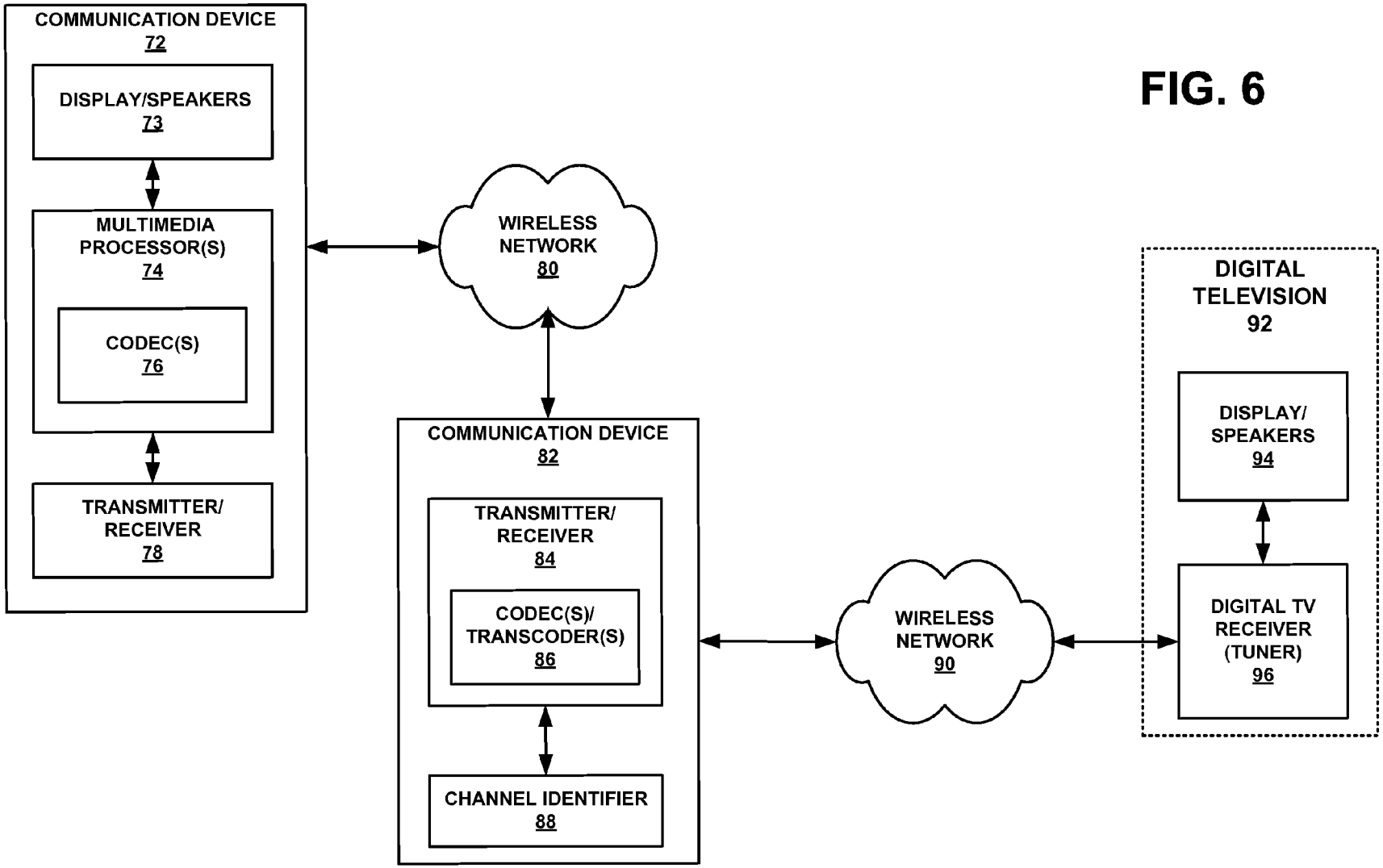
FIG. 6 is a block diagram illustrating another example of a first communication device that communicates with a second communication device via a wireless network, where the second communication device communicates with a digital television (TV) receiver via a wireless network.

FIG. 6 is a block diagram illustrating another example of a first communication device 72 that communicates with a second communication device 82 via a wireless network 80, where the second communication device 82 communicates with a digital TV receiver 96 via a wireless network 90. In some examples, communication device 72 may function similarly to communication device 50 of FIG. 5, and communication device 82 may function similarly to communication device 58 of FIG. 5. Digital TV receiver 96 and display/speakers 94, similar to FIG. 5, may optionally be integrated into a digital TV 92.

As shown in FIG. 6, communication device 72 includes a display and one or more speakers 72, one or more multimedia processors 74, and transmitter/receiver 78. Transmitter/receiving 78 is capable of both receiving and transmitting data, and processing such data for use by communication device 72. As shown in the example of FIG. 6, multimedia processors 74 include one or more codecs (coder/decoders) 76. Codecs 76 may encode data that is to be transmitted by transmitter/receiver 78 of communication device 72 into a particular data format, and may also decode data of a particular format that has been received by transmitter/receiver 78.

Codecs 76 may include one or more video codecs and audio codecs for encoding/decoding video and audio data that has been processed by multimedia processors 74. For example, codecs 76 may include an MPEG-4 codec. In many instances, a mobile device (e.g., a mobile handset, PDA, etc.) may include a MPEG-4 codec to process data compliant with the MPEG-4 (e.g., MPEG-4, Part 2) standard, defined by the Moving Pictures Experts Group.

Communication device 82 includes a transmitter/receiver 84 communicatively coupled to a channel identifier 88. Channel identifier 88 may function similarly to channel identifier 62 shown in FIG. 5. Transmitter/receiver 84 may include functionality that is similar to transformation unit/transmitter 60 of FIG. 5. In some examples, transmitter/receiver 84 may include components similar to those shown in FIG. 2. For instance, transmitter/receiver 84 may include a data receiver for receiving data and a data transmitter for sending data. Transmitter/receiver 84 may optionally include a quieting unit, similar to quieting unit 15 shown in FIG. 2, and also a transformation unit.

In some situations, transmitter/receiver 84 may receive data from communication device 72 that has a different format that used to transmit data to digital TV receiver 96 via wireless network 90. In these cases, transmitter/receiver 84 may need to transform (e.g., encode, transcode) the received data prior to its re-transmission to digital TV receiver 96.

In the particular example of FIG. 6, transmitter/receiver 84 includes one or more codecs and/or transcoders 86. These codecs/transcoders 86 are capable of transforming data of a first format into data of a second, different format. Codecs/transcoders 86 may include one or more audio transcoders and/or video transcoders.

In some situations, codecs/transcoders 86 may perform audio transcoding. For example, codecs/transcoders 86 may transcode audio data into an AC-3 format, which is a format that may be utilized when transmitting data via wireless network 90 to digital TV receiver 96. In some cases, communication device 82 may not perform transcoding for audio data, and may pass such data through from communication device 72 to digital TV receiver 96. However, stereo audio transcoding is often less complex compared to video transcoding, and hence any impact on latency/performance may be less severe. As a result, codecs/transcoders 86 may often include audio transcoding functionality to transcode audio data into a format that complies with any transmission protocol implemented by wireless network 90.

Codecs/transcoders 86 may also include one or more video encoders. Various mobile devices may not support various data formats utilized by digital television broadcast networks (e.g., ATSC-compliant networks). For example, communication device 72 may not include any MPEG-2 encoders within its codecs 76. However, various mobile devices may provide support for MPEG-4 (part 2), and thus codecs 76 of communication device 72 may include an MPEG-4 encoder to support various applications, such as video telephony. Thus, in these types of cases, codecs/transcoders 86 may include transcoders that are capable of transcoding data of an MPEG-4 format to an MPEG-2 format. Codecs/transcoders 86 may also include pre-processing functionality to up-sample the resolution of received data and/or perform frame rate-up conversion to enable high-definition playback on HDTVs (e.g., on digital TV 92).

In general, codecs/transcoders 86 may perform intelligent transcoding operations by selecting a subset of features that are supported both by the format of the data received by communication device 82, via wireless network 80, and the format of the data to be transmitted by communication device via wireless network 90. To provide one very specific example for purposes of illustration, it will be assumed that codecs 76 of communication device 72 includes an MPEG-4 codec, and that codecs/transcoders 86 of communication device 82 include an MPEG-4 to MPEG-2 transcoder.

In this very specific example, which is provided for purposes of illustration but should not be considered limiting, the MPEG-4 to MPEG-2 transcoder may perform transcoding based upon a select group of features that may be supported by both the MPEG-4 and MPEG-2 data formats/standards. To provide a few illustrations, the transcoder may perform header transcoding from MPEG-4 (simple profile) to MPEG-2 (main profile) in an effort to minimize latency and power consumption for the transcoder. Codecs 76 of communication device 72 may encode I (intra) and P (predictive) frames as per the MPEG-4 simple profile and avoid features such as unrestricted motion vectors, which are not part of MPEG-2.

In this case, codecs/transcoders 86 may re-encapsulate I and P frame coded data with MPEG-2 headers (e.g., as per ATSC format), where the coded data (e.g., slice/macroblock data) is not transcoded. Though they may be supported, B (bi-directional) frames may not be used in various cases, in order to reduce decode buffer depth and hence latency. MPEG-4 supports some coding modes not available in MPEG-2, and, as a result, these coding modes may not be utilized by the transcoder when preparing data for transmission to wireless network 90. Furthermore, an MPEG-4 codec in codecs 76 and an MPEG-4 to MPEG-2 transcoder in transcoder 86 may avoid the use of interlaced coding, and instead utilize progressive scan order encoding. In some alternate examples, codecs/transcoders 86 may include a simplified MPEG-2 entropy encoder that may utilize hardware accelerators meant form MPEG-4.

In some instances, it is possible that multimedia processors 74 may not encode a portion of all of the data that is sent to communication device 82. In these instances, codecs/transcoders 86 may encode the received data directly into a data format used for data transmission via wireless network 90. In some cases, it is also possible that codecs 76 of communication device 72 may directly encode outgoing data (e.g., video data, audio data) into a format that is acceptable or otherwise complies with data transmission across wireless network 80 and wireless network 90. In these cases, codecs/transcoders 86 of communication device 82 may not need to encode or even transcode all or a portion of the data received from communication device 72. Instead, codecs/transcoders 86 may pass the data through to digital TV receiver 96.

In those cases in which codecs/transcoders 86 of communication device 82 provide transcoding functionality (e.g., from MPEG-4 to MPEG-2), communication device 82 and communication device 72 may, upon startup or during a configuration stage, perform handshaking or other operations to determine coding functionality that can be used. For example, communication device 72 may specify a set of data formats or standards that are supported by its codecs 76, which is sent to communication device 82. Likewise, communication device 82 may specify, to communication device 72, a set of data formats or standards that are used for data communication across wireless network 90. As one example, communication device 72 may specify that its codecs 76 support an MPEG-4 data format, and communication device 82 may specify to communication device 72 that data communication that it provides across wireless network 90 is to comply with the MPEG-2 format/standard.

During this exchange of information, communication device 72 and communication device 82 may mutually agree upon a data format according to which data is to be sent from communication device 72 to communication device 82 across wireless network 80. For instance, these devices 72 and 82 may agree upon a data format that includes a set of features that are supported by both the MPEG-4 and MPEG-2 standards. Codecs/transcoders 86 may then be capable of performing certain transcoding operations, such as performing header-only transcoding between MPEG-4 and MPEG-2 coded data.

During this process, communication device 72 may also determine coding functionality that may or may not be used for data communication to communication device 82. For instance, as described earlier, after determining which features and data format(s) are used by communication device 82, communication device 72 may adjust the encoding operations that are performed by codecs 76.

For instance, if codecs 76 include an MPEG-4 encoder, communication device 72 may control codecs 76 to encode I and P frames as per an MPEG-4 simple profile, and avoid such features such as unrestricted motion vectors, which are not supported by MPEG-2. In addition, communication device 72 may control codecs 76 to minimize or even avoid the use of B frames, and to avoid the use of coding modes not supported by MPEG-2, such as interlaced coding. By controlling codecs 76 in such fashion, data that is received by communication device 82 may be more efficiently transcoded into an MPEG-2 format by codecs/transcoders 86 for transmission across wireless network 90.

Thus, in some examples, communication device 72 and communication device 82 may initially determine a set of data format features that are common, or usable, by codecs 76 and codecs/transcoders 86. In these examples, codecs/transcoders 86 may perform one or more transcoding operations based upon these common set of features, and may perform header transcoding in some instances, such as, for example, header transcoding from MPEG-4, for data provided by communication device 72, to an MPEG-2 header that is compliant for data communication across wireless network 90.

In some examples, codecs/transcoders 86 may perform transcoding functionality based upon a common set of features that are supported by the different data formats that may be utilized. For instance, codecs/transcoders 86 may be configured to perform transcoding between the MPEG-4 and MPEG-2 data formats. Communication device 82 may be configured to receive data from communication device 72, via wireless network 80, that complies with MPEG-4. However, communication device 82 may need to transmit data across wireless network 90 that complies with the MPEG-2 format. In this case, codecs/transcoders 86 are capable of performing transcoding functionality to transcode the received data from an MPEG-4 format into an acceptable MPEG-2 format for data communication across wireless network 90, based upon a common set of features that are supported by both MPEG-4 and MPEG-2.

Table 1, shown below, shows an example of specific features that are supported by each of the MPEG-2 and MPEG-4 (part 2) data formats/standards. The first column of Table 1 specifies specific features; the second column specifies the support (or potential lack thereof) for these features in MPEG-2; the third column specifies the support (or potential lack thereof) for these features in MPEG-4; and the fourth column specifies the set of common features that are supported by both MPEG-4 and MPEG-2, and which may be used for purposed of encoding and/or transcoding functionality in either or both of communication device 72 and communication device 82.

TABLE 1

| Feature | MPEG-2 | MPEG-4 (Part 2) | Features for MPEG-4 and MPEG-2 |
|---|---|---|---|
| DCT | 8 × 8 | 8 × 8 | Yes |
| Quantization Matrices | Yes | Yes (Non-linear DC quantization for Intra-coding) | Yes (No non-linear DC quantization for Intra-coding) |

TABLE 1-continued

| Feature | MPEG-2 | MPEG-4 (Part 2) | Features for MPEG-4 and MPEG-2 |
|---|---|---|---|
| Scan | ZZ & alternate | 3 scans | Backward compatible ZZ only |
| DC/AC prediction for Intra-coding | Yes (DC) No (AC) | Yes (DC) No (AC) | Simple DC prediction only - no AC prediction. |
| Coding Modes: I, P pictures B pictures | Yes (I, P) Yes (B) | Y PB | Yes (I, P) No B-frames to improve latency and for backward compatibility |
| Motion Compensation block sizes | 16 × 16, 16 × 8 | 16 × 16, 16 × 8, 8 × 8 | 16 × 16 only (1 motion vector per macroblock) (16 × 8 is used for interlaced coding, which is not required) |
| Fractional pel Motion Compensation | ½ pel | ½ pel | ½ pel |
| Interlace field/frame DCT field/frame MC | Yes for both | Yes for both | Interlaced encoding is not required. |
| Error Resilience Resync. markers Data partitioning RVLC | Slice (fixed structure) Yes (data partitioning) No (RVLC) | Variable slice structure Yes (data portioning) Yes (RVLC) | Fixed Slice structure of 1 MB row per slice may be used for simplicity in processing and for latency optimizations. No other error resilience features may be required. (Resilience can be enabled through redundant picture packets in MPEG-2 TS) |
| Scalability Temporal Spatial | Yes (temporal) Yes (spatial) | Yes (temporal) Yes (spatial) | No scalability may be required since these profiles are not presently supported in portable devices or TVs. |
| Filters - noise reduction | No | Yes - post processing filter | Not enabled. Noise reduction may be enabled in select pre-processing. |

In some instances, communication device 72 may further transmit ancillary interactivity data to communication device 82. This interactivity data may include, for example, data corresponding to icons and/or cursors displayed on a display device and that may be controlled or manipulated by a user. A cursor may comprise one example of a icon. For instance, various graphical and/or video data may be displayed to a user of communication device 72 on a display included in display/speakers 73. In addition, one or more cursors or other icons (e.g., arrows) may be displayed on the display. A user may control these cursors or icons via a user interface, such as through manipulation of an input device (e.g., keyboard) or control of a touch-screen or other touch/human interface device provided by display/speakers 73. The cursors or icons themselves may be user-definable or user-selectable.

Communication device 72 is capable of transmitting any graphical, video, or audio data, for instance, to communication device 82, such that communication device 82 may transmit such data via wireless network 90 for output on display/speakers 94. In addition, communication device 72 is capable of transmitting ancillary interactivity data to communication device 82, which may include information regarding the cursors/icons manipulated by a user, and any movement of such cursors/icons in a display. The ancillary interactivity data may then be provided, by communication device 82, to digital TV 92, such that these cursors/icons may also be displayed on display 94. The data received by digital TV 92 may control (e.g., motion, behavior, position of) an icon (e.g., cursor) that is displayed by display 94. This ancillary data may be multiplexed by codecs/transcoders 86 with the associated program data (e.g., audio, video data), or may be multiplexed and sent as an independent program stream across wireless network 90. Codecs/transcoders 86 may, in some examples, utilize and leverage existing closed captioning/subtitle formats used in the digital broadcast format supported by wireless network 90 to transmit the ancillary interactivity data (e.g., using user-defined interactivity headers) to digital TV receiver 96.

Figure 7A:
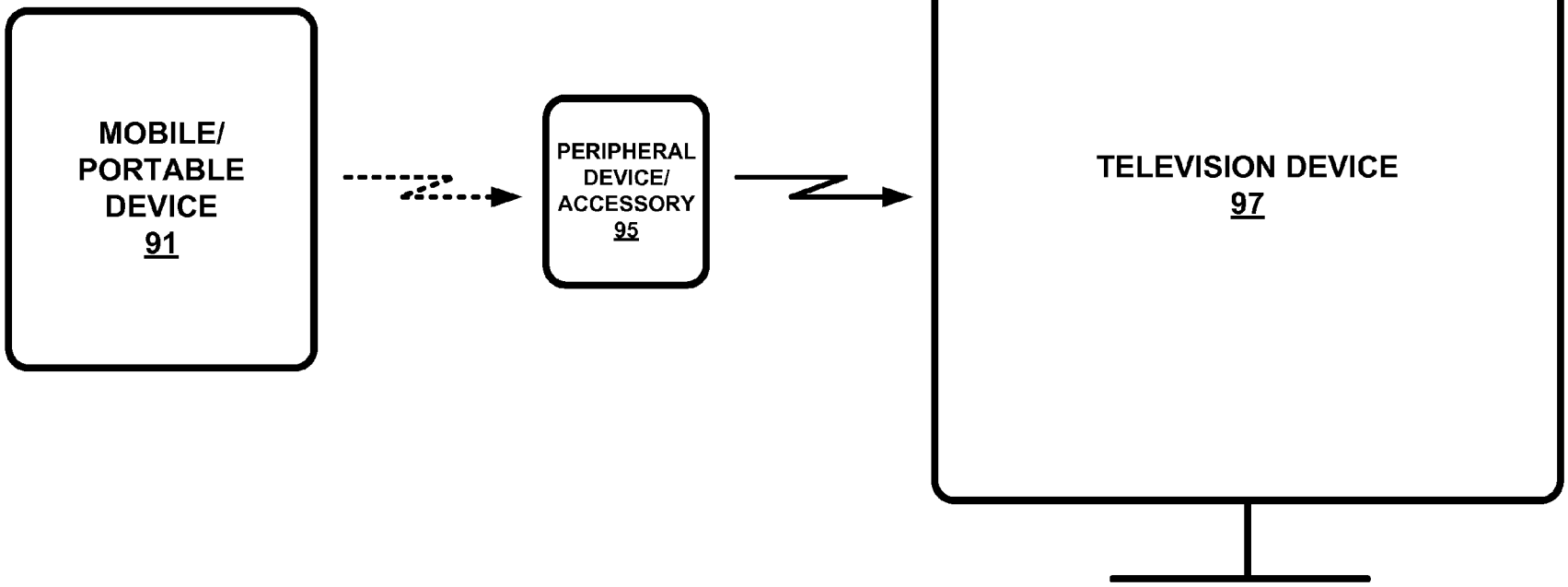
FIGS. 7A-7B are conceptual diagrams illustrating an example of display data being wirelessly transmitted from a first device to a second device, and then being subsequently transmitted by the second device to a TV for purposes of display.
Figure 7B:
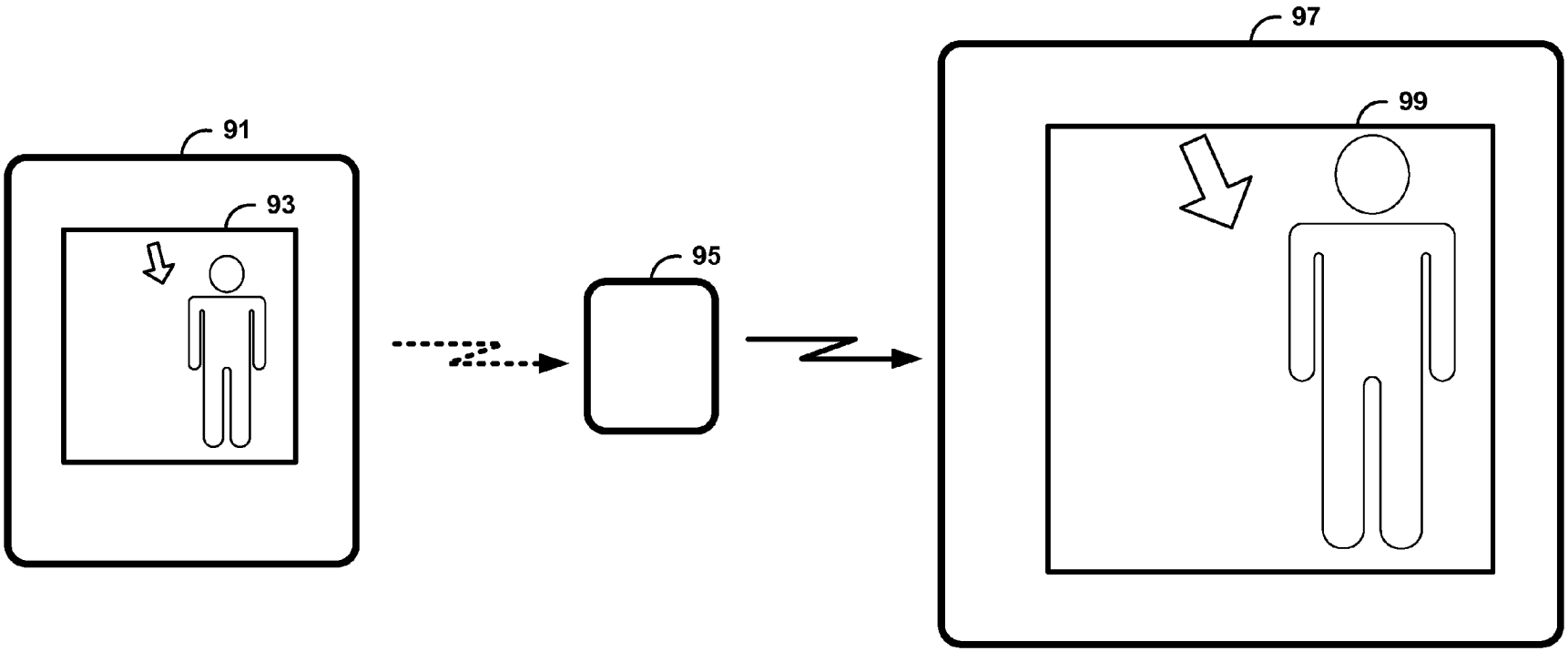

FIGS. 7A-7B are conceptual diagrams illustrating an example of display data being transmitted from a first device 91 (e.g., mobile/portable device 91) to a second device 95 (e.g., peripheral device/accessory to device 91), and then being subsequently transmitted by the second device 95 to a TV 97 for purposes of display. In this example, device 91 may comprise a first communication device, such as communication device 50 shown in FIG. 5. Device 95 may comprise a second communication device, such as communication device 58 shown in FIG. 5. TV 97 may comprise a digital TV, such as digital TV 66 shown in FIG. 5.

In some examples, device 91 may communicate wirelessly (e.g., via a WPAN or WLAN network) with device 95. Device 95 may communicate wirelessly (e.g., via a digital broadcast network for a digital broadcast spectrum) with TV 97. The wireless network coupling device 91 to device 95 may, in some cases, comprise a different network that the wireless network coupling device 95 to TV 97. In some alternate examples, device 95 may be capable of being docked or otherwise directly coupled to device 91. In various examples, device 95 may serve as a bridge between device 91 and TV 97 and provide a mechanism by which data provided by device 91 may be transmitted to TV 97, via device 95, according to a digital broadcast format.

Device 91 includes a display 93, and TV 97 includes a display 99, as shown in FIG. 7B. In some examples, device 91 may comprise a mobile/portable device (e.g., handset, smartphone, laptop) and device 95 may comprise a peripheral or accessory device (e.g., detachable keyboard, mouse) with respect to device 91. In some cases, device 95 may comprise a self-contained, standalone module with respect to device 91. TV 97 may comprise a digital HDTV. Display 99 may or may not include an embedded, or integrated, receiver/tuner.

FIG. 7B illustrates how device 91 may communicate (e.g., wirelessly communicate) with device 95 to provide graphics, video, audio, and/or interactivity data to device 95. Display 93 includes an image of a person, and further includes an arrow icon. The arrow icon may comprise a cursor that is movable via input from a user, such as via manipulation of a touch-screen or other human interface input device of device 91, to select or identify portions of the displayed image data. Device 91 is capable of transmitting the image and user interactivity/ancillary data (e.g., movement of the arrow icon) to device 95 via a wireless (e.g., Wi-Fi, Bluetooth®) transmission.

As a result, a user may utilize a touch-screen (e.g., for screen 93) to control a movement or control of a cursor, or other icon, on screen 99 of TV 97, such as the arrow shown in FIG. 7B. Icons used for cursors may be user selectable or definable for purposes of customization. For example, a user may select a cursor icon from a number of pre-existing icons, or may define or create a user-specific icon. In some examples, closed captioning and subtitle functions that may already exist or be supported in a tuner/receiver of TV 97 may be utilized to encapsulate or transport touch control metadata. For instance, headers or data structures that may otherwise be utilized for closed captioning or subtitle information may instead include touch control information, or metadata, related to the control and movement of an icon or cursor on the display screen.

In some cases, a user may enable device 95 for device 91, particularly if device 95 comprises a peripheral or accessory device (e.g., keyboard, mouse) that communicates with device 91. In some instances, a user may manually enable the connectivity between devices 91 and 95, such as, for example, by selecting an option or button on device 91 and/or by selecting an option or button on device 95. However, in some instances, device 95 may automatically become enabled, such as if device 91 is powered on or put into a particular operating mode.

The user may then initiate the applications on devices 91 and 95 that allow the exchange (e.g., wireless exchange) of data between these devices. For example, the user may select a particular option or button on device 91, or screen 93, to initiate the applications. Alternatively, if device 95 comprises a device with user input controls (e.g., keys on a keyboard), the user may select one of these controls on device 95 to initiate the applications.

If device 95 identifies one or more available channels (e.g., white space) for data transmission to TV 97, device 95 may communication the identifiers of these channels to device 91, such that device 91 may select one or more of these channels for use. For example, device 91 may automatically select one or more of these channels. In some cases, device 91 may display the available channels on screen 93, and allow the user to select one or more of the channels. In other cases, device 95 may automatically select one or more of the identified channels for use. Upon selection of a channel, device 95 may include a channel transmitter (e.g., channel transmitter 11), such as an IR-based transmitter, to communicate channel, and channel change, information to TV 97, such that TV 97 is capable of automatically tuning to an appropriate channel and receive data from device 95.

Device 95 is capable of transmitting the image and user interactivity/ancillary data to a receiver included in TV 97 via a broadcast (e.g., digital TV) communication. In some instances, device 95 may encode and/or transcode the received data prior to transmitting it to the receiver of TV 97. TV 97 is then capable of displaying the image and user interactivity data on display 99, perhaps with increased size and/or resolution.

In such fashion, a user is able to wirelessly extend the display 93 of device 91 to TV 97. In some instances, devices 91, 95, and TV 97 may be located in general proximity, such as in the same room, house, or general area. If display 93 is too small or limiting, for example, the user may wish to view the display data on a much larger display 99 of TV 97, which may provide higher image resolution as well. Any interactivity with the arrow icon on display 93 may also be captured and displayed on display 99. Because device 95 may include transcoding functionality, device 91 may not need to include any specialized functionality in some cases.

All specialized data formatting, converting, transcoding, and the like, may be performed by device 95, in order to format data according to the broadcast format/standard that may be expected by the receiver of TV 97. In these cases, device 95 may function as a form of tv-adapter, providing device 91 a direct interface to TV 97 without any additional hardware components for TV 97, such as, for example, a set-top box or other intermediate device used to decode any received data prior to presentation on display 99 of TV 97. Device 95 is capable of formatting data into an appropriate format (e.g., digital TV format) that may be received and processed directly by a tuner/receiver of TV 97 to enable seamless interoperability with TV 97. All of the functionality of device 95 may be included within a peripheral/accessory component of device 91, which is capable of communicating (e.g., wirelessly) with device 91. For example, device 95 may comprise a detachable keyboard or mouse device usable with device 91.

In some cases, a user of device 91 may wish to view data on both display 93 and display 99. However, because display 93 may have some limitations with respect to resolution, size, and other factors, a user may also disable display functionality on display 93 while displaying data on display 99 (e.g., if device 97 comprises a large-screen HDTV). For example, if the data to be displayed on screen 93 is very large and may not entirely fit on screen 93 for easy viewing, a user may wish, in some particular examples, to disable display functionality on display 93 and only view such information on display 99 of TV 97. In such fashion, a user is able to view a large amount of content on display 99 of TV 97 when such content may not entirely fit on display 93.

In some cases, the data sent from device 91 to device 95 may include display information of device 91. The display information may include primary display data that is rendered on device 91. For example, the primary display data may include any data that is displayed on display 93 of device 91. Device 95 may then transmit the data from device 95 in at least one identified channel by transmitting the primary display data to TV 97 for purposes of display.

In some instances, however, transmitting the data from device 95 in the at least one identified channel may include transmitting secondary display data that is different from primary display data displayed on display 93 of device 91. Device 95 may receive display information from device 91 that includes the secondary display data which is not actually displayed on display 93. However, the secondary display data may be displayed on display 99 upon receipt by TV 97 from device 95. For instance, this may occur when a user of device 91 may want to look at content (e.g., web pages, desktop information) that may not entirely fit on display 93.

In some examples, the display data sent by device 91 to device 95 may include both primary display data that may be displayed by display 93 and also secondary display data that is different from the primary display data, where the secondary display data is not displayed display 93 of device 91 (e.g., if the secondary display data does not fit on display 93). In these examples, device 95 may transmit the primary display data and/or the secondary display data to TV 97 for purposes of display. For instance, if display 99 of TV 97 is larger than display 93 of device 91, display 99 may be capable of displaying a larger amount of data, such as, for instance, by displaying the secondary display data. Display 99 of TV 97 may also be configured to display the primary display data.

Figure 8:
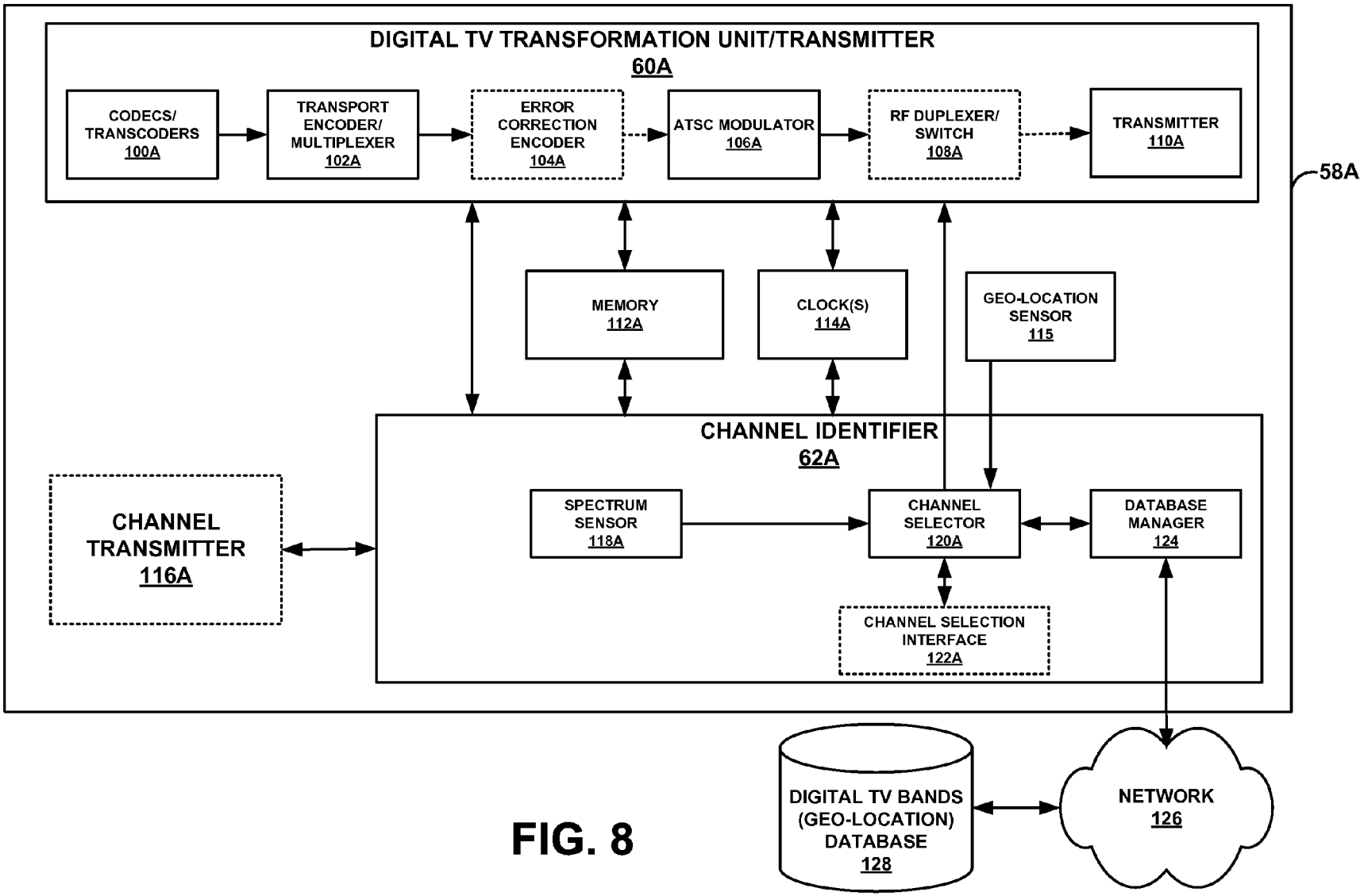
FIG. 8 is a block diagram illustrating an example of a transformation unit/transmitter, in conjunction with a channel identifier, which may be implemented within a communication device, such as one of the communication devices shown in FIG. 5.

FIG. 8 is a block diagram illustrating an example of a digital TV transformation unit/transmitter 60A, in conjunction with a channel identifier 62A, which may be implemented within a communication device 58A. In FIG. 8, digital TV transformation unit/transmitter 60A may be one example of digital TV transformation unit/transmitter 60 shown in FIG. 5, while channel identifier 62A may be one example of channel identifier 62 shown in FIG. 5. In the particular example of FIG. 8, communication device 58A is capable of broadcasting multimedia data according to a specific digital broadcast format, ATSC.

Communication device 58A may facilitate low-power transmission to an ATSC-ready external device, such as a high-definition or flat-panel television. In this case, the ATSC-ready device may comprise digital TV 66 of FIG. 5 or digital TV 92 of FIG. 6. The ATSC-ready device may, in some examples, include both a display device and a tuner/receiver.

As shown in FIG. 8, digital TV transformation unit/transmitter 60A may include various components, such as one or more codecs/transcoders 100A, transport encoder/multiplexer 102A, error correction encoder 104A, ATSC modulator 106A, radio frequency (RF) duplexer/switch 108A, and transmitter 110A. These components help support data transmission over a spectrum implementing the ATSC standard. The ATSC standard is a multi-layered standard that provides layers for video encoding, audio encoding, transport streams, and modulation. In one example, RF duplexer/switch 108A may comprise an ultrahigh frequency (UHF) duplexer/switch. A duplexer may allow for signals to be received for sensing purses and to be transmitted for communication purposes.

Codecs/transcoders 100A may include one or more video codecs and one or more audio codecs to encode/decode video and/or audio data into one or more streams. For example, codecs/transcoders 100A may include a Moving Picture Experts Group-2 (MPEG-2) codec or a H.264 codec (from the Telecommunication Standardization Sector, ITU-T) to encode/decode video data. Codecs/transcoders 100A may also include a Dolby Digital (Dolby AC-3) codec to encode/decode audio data. An ATSC stream may contain one or more video programs and one or more audio programs. Any of the video encoders may implement a main profile for standard definition video or a high profile for high-definition resolution video. In some cases, codecs/transcoders 100A may include one or more transcoders to transcode data from one format to another, such as described above in reference to codecs/transcoders 86 of FIG. 6.

Transport (e.g., MPEG-2 Transport Stream, or TS) encoder/multiplexer 102A receives the data streams from codecs/transcoders 100A and is capable of assembling these data streams for broadcast, such as into one or more packetized elementary streams (PESs). These PESs may then be packetized into individual program transport streams. Transport encoder/multiplexer 102A may optionally, in some instances, provide the output transport streams to an error correction encoder 104A (e.g., a Reed-Solomon encoder), which may perform error correction encoding functionality by adding one or more error correction codes associated with the transport streams. These error correction codes may be used by a data receiver for error correction or mitigation.

ATSC modulator 106A is capable of modulating the transport streams for broadcast. In some example cases, for instance, ATSC modulator 106A may utilize 8 vestigial side band (8VSB) modulation for broadcast transmission. RF duplexer/switch 108A may then duplex the transport streams, or act as a switch for the transport streams. Transmitter 110A is capable of broadcasting one or more transport streams to one or more external devices using one or more available channels that are identified by channel identifier 62A.

Channel identifier 62A includes a database manager 124, a channel selector 120A, an optional channel selection user interface (UI) 122A, and a spectrum sensor 118A. Both channel identifier 62A and digital TV transformation unit/transmitter 60A are coupled to a memory 112A, which may comprise one or more buffers. Channel identifier 62A and digital TV transformation unit/transmitter 60A may exchange information directly, or may also exchange information indirectly through the storage and retrieval of information via memory 112A.

Channel identifier 62A includes a spectrum sensor 118A. As discussed previously, a spectrum sensor, such as spectrum sensor 118A, is capable of sensing signals in one or more frequency bands within a broadcast spectrum for a particular digital TV format, such as ATSC. Spectrum sensor 118A may determine current channel availability and signal strengths based upon its ability to identify any data that occupies one or more used channels within the spectrum. Spectrum sensor 118A may then provide information to channel selector 120A as to the channels that are currently unused, or available. For example, spectrum sensor 118A may detect that a particular channel is available if it does not detect any data being broadcast on this channel by any external, separate devices.

As shown in FIG. 8, channel selector 120A may also receive information from digital TV bands database via network 126 and database manager 124. Digital TV bands database 128 is located external to communication device 58A and includes information regarding channels that are currently in use or available within the broadcast spectrum for a particular digital TV format, such as ATSC. Typically, the digital TV bands database 128 is updated dynamically as channels are put into use or freed for use by other devices. In some instances, digital TV bands database 128 may be organized by geographic location/region or by frequency bands (e.g., low very high frequency (VHF), high VHF, ultrahigh frequency (UHF)).

In order for channel identifier 62A to obtain channel availability information from digital TV bands database 128, channel identifier 62A may, in some cases, provide geo-location information as input into digital TV bands database 128. Channel identifier 62A may obtain geo-location information or coordinates from geo-location sensor 115, which may indicate the geographic location of communication device 58A at a particular point in time. Geo-location sensor 115 may, in some examples, comprise a GPS sensor.

Upon receipt of geo-location information from geo-location sensor 115, channel selector 120A may provide such information, as input, to digital TV bands database 128 via database manager 124. Database manager 124 may provide an interface to digital TV bands database 128. In some cases, database manager 124 may store a local copy of selected contents of digital TV bands database 128 as they are retrieved. In addition, database manager 124 may store select information provided by channel selector 120A to digital TV bands database 128, such as geo-location information.

Upon sending geo-location information pertinent to communication device 58A, channel selector 120A may receive from digital TV bands database 128 a set of one or more available channels as presented listed within digital TV bands database 128. The set of available channels may be those channels that are available in the geographic region or location presently occupied by communication device 58A, as indicated by geo-location sensor 115.

Upon receipt of available channel information from either or both of spectrum sensor 118A and digital TV bands database 128, channel selector 120A may select one or more available channels, either automatically or via user input via channel selection UI 122A. Channel selection UI may present available channels within a graphical user interface, and a user of a service or application may select one or more of these available channels.

In some cases, database 128, once updated, may indicate that the selected channels are in use by communication device 58A until communication device 58A sends a subsequent message to database 128 indicating that the channels are no longer needed or being used. In other cases, database 128 may reserve the selected channels for communication device 58A only for a defined interval of time. In these cases, communication device 58A may send a message to database 128 within the defined interval of time indicating that device 58A is still using the selected channels, in which case database 128 will renew the reservation of the selected channels for a second interval of time for use by communication device 58A.

One or more clocks 114A may be included within communication device 58A. As shown in FIG. 8, clocks 114A may be utilized by, or drive the operation of, digital TV transformation unit/transmitter 60A and channel identifier 62A. Clocks 114A may be configured or set by communication device 58A. In some cases, clocks 114A may be configured by or synchronized to a clock that is external to device 58A. For example, device 58A may receive clock or timing information from an external device (e.g., via geo-location sensor 115) and may configure or synchronize clocks 114A based upon the received information.

For example, in some scenarios, communication device 58A may implement clock functionality that is common with a receiving device (e.g., digital TV receiver 70 of FIG. 5 or digital TV receiver 96 of FIG. 6). In these scenarios, both communication device 58A and the receiving device may receive clock or timing information from an external device and synchronize their own internal clocks based upon the received information. In such fashion, communication device 58A and the receiving device may effectively operate using a common clock. Digital TV transformation unit/transmitter 60A and channel identifier 62A may also utilize clocks 114A to synchronize or align certain operations.

As also shown in FIG. 8, communication device 58A further includes a channel transmitter 116A, which is communicatively coupled to channel identifier 62A. Channel identifier 62A may provide, to channel transmitter 116A, information associated with a channel used by digital TV transformation unit/transmitter 60A in transmitting data.

Channel transmitter 116A is then capable of transmitting channel command information that either directly or indirectly identifies the channel. For example, the channel command information may include a specific identification of the channel. In this example, a data receiver (e.g., digital TV receiver 70 of FIG. 5 or digital TV receiver 96 of FIG. 6) is able to determine the channel directly from the received command information. In other cases, the channel command information transmitted by channel transmitter may indirectly identify the channel (e.g., via channel up/down information). In these cases, the data receiver is able to determine the channel by processing the received command information along with state or other information that the data receiver has stored relating to the channel that was previously used for data transmission.

In some examples, digital TV transformation unit/transmitter 60A may further include a transmission quieting unit (not shown). This quieting unit may function similarly to quieting unit 15 shown in FIG. 2 to quiet data transmission during one or more time intervals in which time spectrum sensing operations (e.g., by spectrum sensor 118A) are performed.

Figure 9:
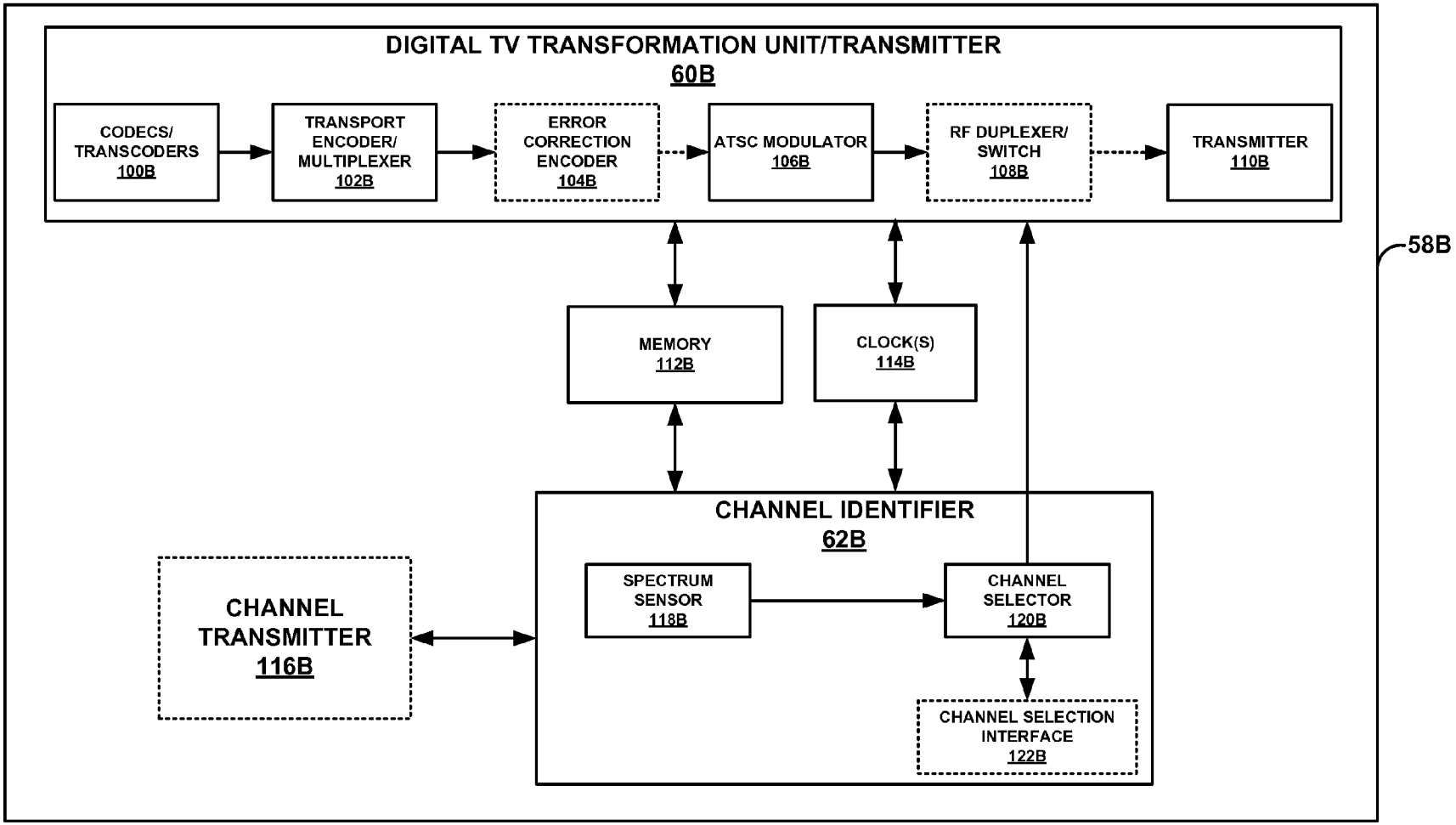
FIG. 9 is a block diagram illustrating another example of a transformation unit/transmitter, in conjunction with a channel identifier, which may be implemented within a communication device, such as one of the communication devices shown in FIG. 5.

FIG. 9 is a block diagram illustrating another example of a digital TV transformation unit/transmitter 60B, in conjunction with a channel identifier 62B, which may be implemented within a communication device 58B. In FIG. 9, digital TV transformation unit/transmitter 60B may be one example of digital TV transformation unit/transmitter 60 shown in FIG. 5, while channel identifier 62B may be one example of channel identifier 62 shown in FIG. 5. Digital TV transformation unit/transmitter 60B and channel identifier 62B may each store and retrieve information from memory device 112B.

Similar to digital TV transformation unit/transmitter 60A, digital TV transformation unit/transmitter 60B includes one or more codecs/transcoders 100B, a transport encoder/multiplexer 102B, an error correction encoder 104B, an ATSC modulator 106B, an RF duplexer/switch 108B, and transmitter 110B. One or more clocks 114B may be utilized by both digital TV transformation unit/transmitter 60B and channel identifier 62B.

Channel identifier 62B of FIG. 7B differs from channel identifier 62A of FIG. 7B in that channel identifier 62B does not include a database manager interfacing to a digital TV bands database. In FIG. 8, channel identifier 62B includes only a spectrum sensor 118B. Because no geo-location functionality is implemented in the example of FIG. 8, communication device 58B does not include a geo-location sensor. Channel selector 120B identified one or more available channels for broadcast transmissions based upon the input received from spectrum sensor 118B. Channel selector 120B may also receive a user selection of a channel from a list of available channels via an optional channel selection interface 122B. The list of available channels may be presented on the channel selection interface 122B based upon the sensed signal information provided by spectrum sensor 118B.

Figure 10:
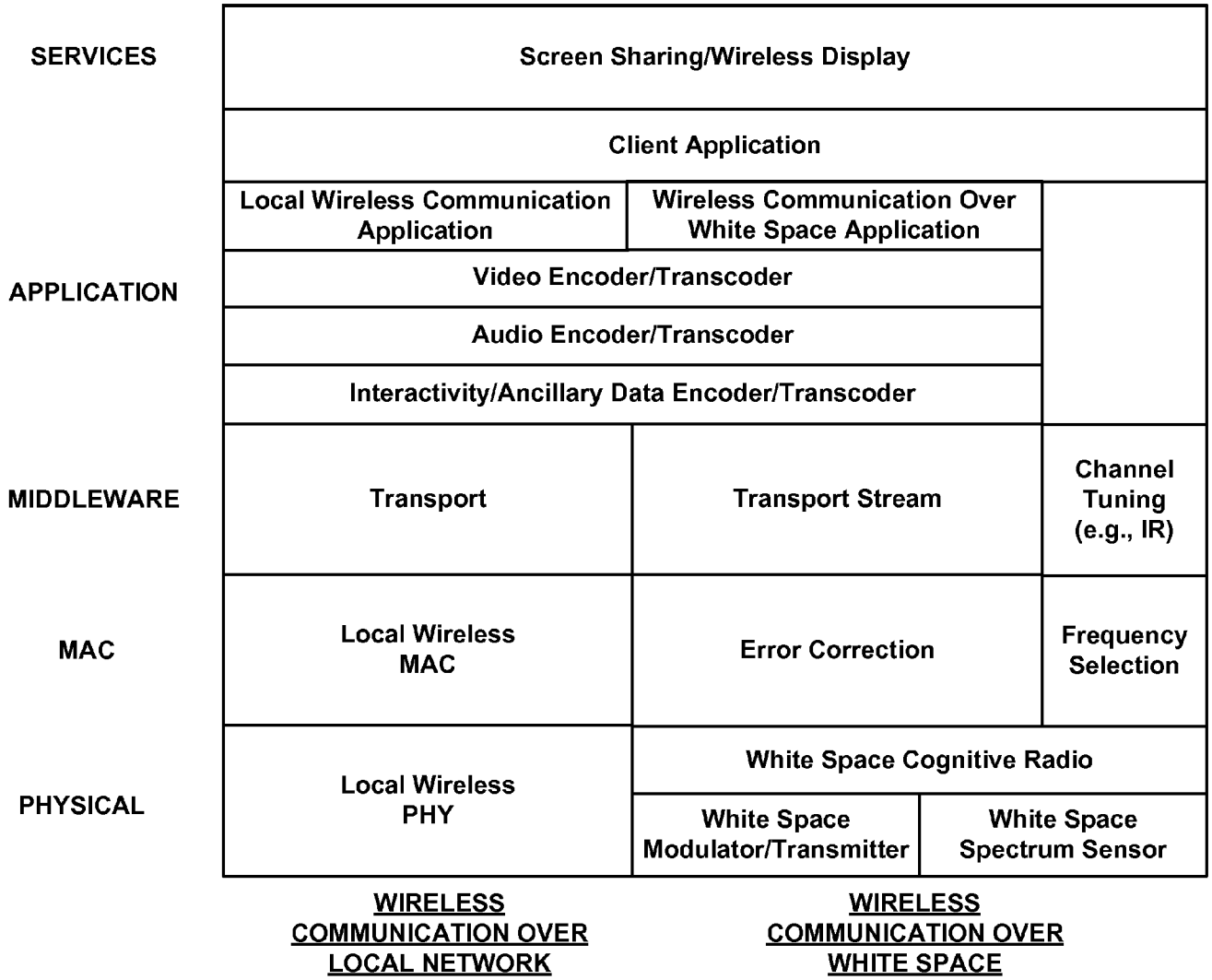
FIG. 10 is a conceptual diagram illustrating an example of a protocol stack that may be implemented for data communication by a communication device, such as one of the communication devices shown in any of FIGS. 1-6.

FIG. 10 is a conceptual diagram illustrating an example of a protocol stack that may be implemented for data communication by a communication device, such as one of the communication devices shown in any of FIGS. 1-6. For purposes of illustration only, it will be assumed in the description of FIG. 10 below that the protocol stack is implemented by communication device 82 of FIG. 6.

As shown in the conceptual diagram of FIG. 10, the example protocol stack includes exemplary layers at the physical, medium access control (MAC), middleware, application, and services layers. Communication device 82 may include multiple layer elements at various layers within the communication protocol stack. Various ones of these elements may be included to implement wireless communication over a local network, such as wireless communication between communication device 82 and communication device 72 via wireless network 80 in FIG. 6. The local wireless network may comprise a wireless local area network, such as a Wi-Fi or Bluetooth® network.

To facilitate this wireless communication, the protocol stack may include local wireless layer elements (e.g., 802.11g/n layer elements for Wi-Fi communication) at both the physical and MAC layers. A transport layer element may also be implemented at the middleware layer. For example, the Transmission Control Protocol/Internet Protocol (TCP/IP), or the Real-time Transport Protocol (RTP)/User Datagram Protocol (UDP) may be implemented at the middleware layer. In some cases, these layer elements may be implemented by transmitter/receiver 84.

Various layer elements may also be included to implement wireless communication over a digital broadcast network, such as wireless communication between communication device 82 and digital TV receiver 96 via wireless network 90 in FIG. 6. The digital broadcast network may comprise a digital TV network, such as a network compliant with the ATSC standard.

To provide support for these communications, the protocol stack may include spectrum sensing and modulation/transmission layer elements (e.g., for ATSC) at the physical layer. The spectrum sensing element may attempt to identify white space within a spectrum, such as one or more available channels within wireless network 90. The modulation/transmission layer element may be capable of providing transmission across available white space to digital TV receiver 96. In some examples, the spectrum sensing and modulation/transmission layer elements may be included within a white space cognitive radio element at the physical layer, which may be implemented by channel identifier 88 and/or transmitter/receiver 84.

Channel identifier 88 may also implement a frequency selection layer element at the MAC layer to select one or more available channels within identified white space. An error correction element (e.g., ATSC forward error correction, or FEC) may also be implemented at the MAC layer to perform one or more error correction functions at this layer.

A transport stream layer element may be implemented at the middleware layer for transport stream communication (e.g., MPEG-2 TS, transport stream) to digital TV receiver 96 via wireless network 90. In some examples, a channel tuning element may be implemented at the middleware layer, which may be implemented by a channel transmitter (e.g., channel transmitter 11 shown in FIG. 1) to communication channel information (e.g., via IR communication) to a data receiver, such as digital TV receiver 96.

Various different layer elements may be implemented within the application layer of the example protocol stack shown in FIG. 10. Various different encoders and/or transcoders may be implemented in this layer. For example, encoders and/or transcoders for video, audio, and/or interactivity/ancillary (e.g., cursor/icon) data may be provided. These layer elements may be implemented by codecs/transcoders 86, which were previously described with reference to FIG. 6. In one example, the audio encoder/transcoder layer element may provide support for AAC (advanced audio coding) to AC-3 transcoding, or MPEG-I Layer II transcoding. In one example, the video encoder/transcoder layer element may provide support for MPEG-4 (part 2) to MPEG-2 transcoding.

As shown in FIG. 10, the application layer also includes the two applications implemented by communication device 82 for wireless communication: a first wireless communication application to support local wireless communication with communication device 72; and a second wireless communication application to support wireless communication over identified white space in a digital television broadcast network to digital TV receiver 96. In some instances, these applications may be included within a client application within communication device 82.

Finally, at the services layer, communication device 82 provides support for screen sharing and wireless display, such as shown in the example of FIG. 7B. Through interactivity with communication device 82, data displayed on display 73 of communication device 72 may be extended for wireless display on digital TV 92, which includes digital TV receiver 96. Communication device 72 is capable of wirelessly communicating such data to communication device 82 via wireless network 80, and communication device 82 is able to wirelessly communicate the data, via wireless network 90, for display on digital TV 92.

Figure 11:
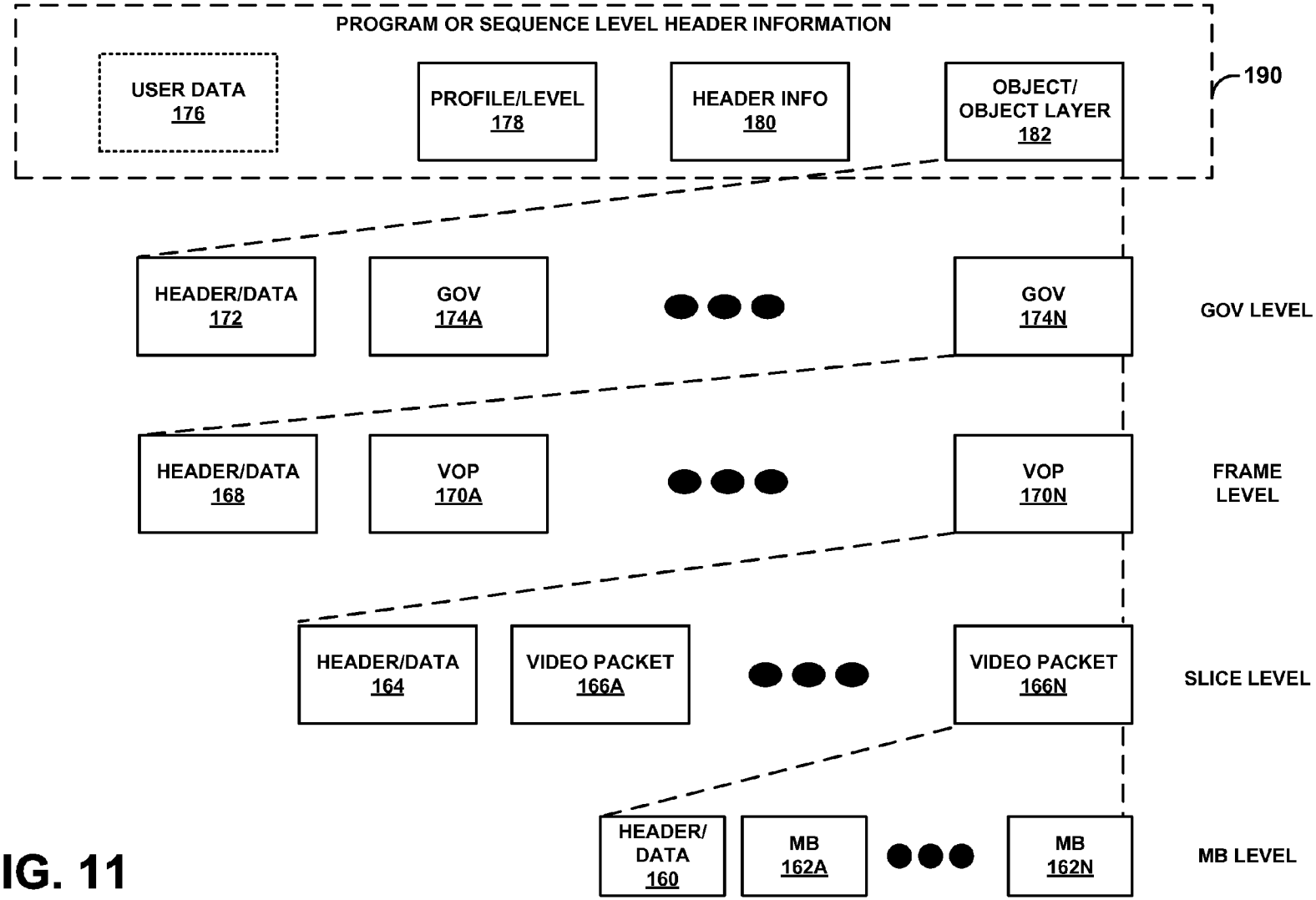
FIG. 11 is a conceptual diagram illustrating an example data format of data that may be transmitted by a first communication device to a second communication device.

FIG. 11 is a conceptual diagram illustrating an example data format of data that may be transmitted by a first communication device to a second communication device. In one example, the example data format shown in FIG. 11 may comprise bitstream structure for video data (e.g., MPEG-4 data) that is sent from one communication device (e.g., communication device 72) to another communication device (e.g. communication device 82).

As shown in FIG. 11, the example data format, or data structure, includes multiple different data elements at different levels. For example, data that is compliant with or formatted according to the data format of FIG. 11 may include data elements at the macroblock (MB) level, at the slice level, at the frame level, and at the GOV (group of video object planes) level.

The MB level may include one or more macroblocks 162A-162N and also additional data or header information 160. Header/data 160 may include a video packet header. Each macroblock 162A-162N may include a macroblock header. At this MB level, there may be one or more groups of the macroblock-header information shown in FIG. 11.

The slice level may include one or more video packets 166A-166N and also additional data or header information 164. As shown in FIG. 11, each video packet 166A-166N may comprise data from the MB level. Thus, video packet 166N may comprise macroblocks 162A-162N and header/data 160. Each of the other video packets (e.g., video packet 166A) may also comprise one or more macroblocks, similar to macroblocks 162A-162N, and also additional header information or data, similar to header/data 160. Header/data 164 at the slice level may include various information, such as configuration information, marker bits, time information, coding type information (e.g., VOP coding type information), or other information (e.g., within an MPEG-4 bitstream structure).

The frame level may include one or more video object planes (VOP) 170A-170N and additional data or header information 168. Each VOP 170A-170N may comprise data from the slice level. For example, VOP 170N may comprise video packets 166A-166N and header/data 164. Each of the other VOPs (e.g., VOP 170A) may also comprise one or more video packets and additional header information or data. Header/data 168 at the frame level may include various types of information, such as user data.

The GOV level may include one or more GOVs 174A-174N and additional data or header information 172. Each GOV 174A-174N may comprise data from the frame level. For example, GOV 174N may comprise VOPs 170A-170N and header/data 168. Each of the other GOVs (e.g., GOV 174A) may also comprise one or more VOPs and additional header information or data. Header/data 172 at the GOV level may include various types of information, including configuration information (e.g., for an MPEG-4 bitstream).

The data format, or structure, shown in FIG. 11 also includes program or sequence level header information 190. Header information 190 may include various types of information. For example, header information 190 may include profile/level information 178, header information 180, and object/object layer information 182. Header information 190 may optionally include user data 176.

Object/object layer 182 may include a video object layer, which may comprise data at the GOV level (e.g., GOVs 174A-174N and header/data 172). A video object layer in object/object layer 182 may be included within a video object, which may be part of a visual object (e.g., for an MPEG-4 structure). Header information 180 may include various types of information, such as video signal type information, video object identifiers, and object types. Profile/level 178 includes profile information that may be specific to the data format or structure. Header information 190 may further optionally include an user data 176 that may be provided by, or customized for, a particular user.

As described above, the example data format shown in FIG. 11 may comprise bitstream structure for video data (e.g., MPEG-4 data) that is sent from one communication device (e.g., communication device 72) to another communication device (e.g. communication device 82). The communication device that receives the data, such as communication device 82, may use one or more codecs and/or transcoders (e.g., codecs/transcoders 86) to transform the data into a different format that may be used for wireless communication across another network (e.g., wireless network 90).

In many instances, transcoding operations may only transcode header information, such as header information 190, into a different format. In these instances, the data within the GOV level, frame level, slice level, and macroblock level may not be transcoded at all, but remain intact. For instance, if a transcoder transcodes data from an MPEG-4 format, compliant with the format shown in FIG. 11, into an MPEG-2 format, the transcoder may only transcode header information 190 into a format compliant with MPEG-2. This form of header transcoding may help minimize latency and power consumption, while increasing processing efficiency, within the communication device. The codecs and/or transcoder (e.g., codecs/transcoders 86) may also only perform header transcoding in cases where entropy encoding, or even partial entropy encoding, is performed. In these cases, the codecs may comprise an MPEG-2 entropy encoder that may utilize hardware accelerators meant for MPEG-4.

In some examples, the codecs/transcoders (e.g., codecs/transcoders 86 of FIG. 6) may only perform header transcoding when a communication device that has sent the data of the data format shown in FIG. 11 (e.g., device 72 in FIG. 6) has encoded the data in the GOV, frame, slice, and/or MB levels in a certain manner. For instance, if communication device 72 sends to communication device 82, MPEG-4 data according to the data format shown in FIG. 11, and communication device 82 needs to send data of an MPEG-2 data format to digital TV receiver 96, communication device 82 and communication device 72 may determine, as described previously above, to avoid certain features of MPEG-4 encoding that are not supported by MPEG-2. That is, codecs 76 of communication device 72 may encode the data into an MPEG-4 format utilizing a subset of features that are commonly supported by MPEG-4 and MPEG-2, and may avoid other features (e.g., unrestricted motion vectors, B frames, interlaced coding). In these cases, codecs/transcoders 86 may be able to perform header-only transcoding, and may not need to transcode macroblock data, slice data, frame data, or GOV data that it has received from communication device 72.

In other examples, it is possible that the codecs/transcoders may perform header transcoding and/or other data transcoding. For instance, in some cases, a transcoder may potentially transcode data in more or more of the macroblock, slice, frame, and/or GOV levels shown in FIG. 11 in order to properly convert the data into a format (e.g., MPEG-2) that is sent to a digital TV receiver via a digital broadcast network.

Figure 12:
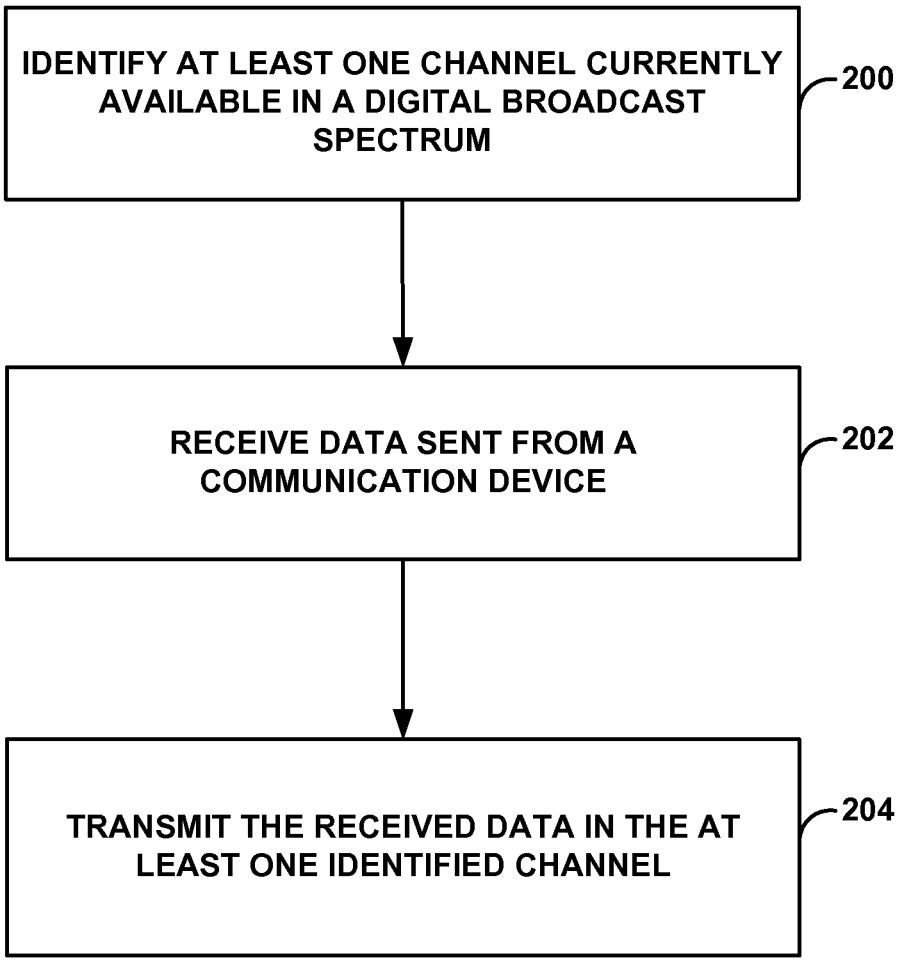
FIG. 12 is a flow diagram illustrating an example of a method that may be performed by a communication device, such as one of the communication devices shown in any of FIGS. 1-6.

FIG. 12 is a flow diagram illustrating an example of a method that may be performed by a communication device, such as one of the communication devices shown in any of FIGS. 1-6. The communication device may identify (e.g., using a channel identifier) at least one channel currently available in a digital broadcast spectrum (200). The communication device may receive data (e.g., using a data receiver) sent from a second, different communication device (202), and may then transmit the data (e.g., using a data transmitter) in the at least one identified channel of the digital broadcast spectrum, wherein the transmitted data complies with a digital broadcast format (204).

In some examples, the communication device may identify the at least one channel in an unused portion of a digital broadcast television spectrum, and transmit the data according to a digital broadcast format in the at least one identified channel of the digital broadcast television spectrum. In some examples, the communication device may identify the at least one channel by identifying television band white space. The digital broadcast format may, to name only a few non-limiting examples, comprise an ATSC format, a T-DMB format, a DVB format, an Integrated Services Digital Broadcasting Terrestrial format, or an MPEG-TS format.

In some examples, the second communication device may be docked. In some examples, receiving the data sent from the second communication device may include receiving the data sent from the second communication device over a wireless network, and the wireless network may be different from a broadcast network for the digital broadcast spectrum.

The data sent from the second communication device may include display information of the second communication device. The display information may include primary display data that is rendered on the second communication device, and transmitting the data from the first communication device in the at least one identified channel may include transmitting the primary display data. In some instances, however, transmitting the data from the first communication device in the at least one identified channel may include transmitting secondary display data that is different from primary display data displayed by the second communication device. For instance, this may occur when a user of the second communication device may want to look at content (e.g., web pages, desktop information) that may not fit on a display screen of the second communication device.

In some examples, the data sent from the second communication device may include data provided by a human interface device of the second communication device, and transmitting the data from the first communication device in the at least one identified channel may include transmitting the data provided by the human interface device to an external device, wherein the data provided by the human interface device is capable of being used by the external device to control an icon that is displayed by the external device. The human interface device of the second communication device may comprise a touch interface, such as a touch screen. As such, the touch screen of the second communication device could be used as, for example, a touch pad to control a cursor or other icon on the display of the external device (e.g., television screen).

The communication device may receive data of a first data format from the second communication device, and the communication device may transform the data of the first data format into data of a second data format, the second data format being compliant with the digital broadcast format. The communication device may then transmit the data of the second format in the at least one identified channel. The data of the first data format and the data of the second data format may each include at least one of audio data, video data, text data, speech data, graphics data, and ancillary interactivity data.

In some cases, the communication device may transform the data of the first data format into data of the second data format by encoding the data of the first data format to generate encoded data that complies with the second data format. In some cases, the communication device may transform the data of the first data format into data of the second data format by transcoding the data of the first data format into the data of the second data format. The communication device may transcode the data of the first data format into the data of the second data format based upon a set of features that are common to and supported by both the first data format and the second data format. In some cases, the communication device may send information to the second communication device in order to specify the second data format.

In one specific example, which is described only for purposes of illustration and is should not be considered limiting, the communication device may transcode video data from the first data format into video data of the second data format. The first data format may comprise an MPEG-4 format, and the second data format may comprise an MPEG-2 format.

If the communication device includes a quieting unit (e.g., quieting unit 15 of FIG. 2), the communication device may detect, during at least one time interval, whether the at least one identified channel continues to be available for use. During the at least one time interval, the communication device may refrain from transmitting any data.

In some examples, the communication device may determine that the at least one identified channel is no longer available for further use and identify at least one other channel that is currently available in the digital broadcast spectrum. The communication device may receive additional data sent from the second communication device, and transmit the additional data in the at least one other identified channel of the digital broadcast spectrum, wherein the transmitted additional data complies with the digital broadcast format. If the communication device includes a channel transmitter (e.g., channel transmitter 11 of FIG. 1), the communication device may transmit at least one message to a third device (e.g., one or more of data receivers 9), wherein the at least one message contains information that allows the third device to determine a channel change from the at least one identified channel to the at least one other identified channel.

The communication device may include a spectrum sensor (e.g., spectrum sensor 118A of FIG. 8 or 118B of FIG. 9). The communication device may use the spectrum sensor to identify the at least one channel. In some examples, the communication device may further access a digital TV bands database (e.g., database 128 of FIG. 8). In these examples, the communication device may further access the digital TV bands database to identify the at least one channel.

In some examples, the communication device may identify multiple available channels of the digital broadcast spectrum. The communication device may receive a selection (e.g., from the communication device itself or from another device) of at least one of the multiple available channels, and may transmit the data in at least one of the selected channels. In some instances, the communication device may receive such a selection based upon an automatic selection, from the communication device, of at least one of the multiple available channels. In other cases, the communication device may send an indication of the identified multiple available channels to another device (e.g., the second communication device). In these cases, the communication device may receive the selection of at least one of the multiple available channels from the other device.

The techniques described in this disclosure may be implemented within one or more of a general purpose microprocessor, digital signal processor (DSP), application specific integrated circuit (ASIC), field programmable gate array (FPGA), programmable logic devices (PLDs), or other equivalent logic devices. Accordingly, the terms "processor" or "controller," as used herein, may refer to any one or more of the foregoing structures or any other structure suitable for implementation of the techniques described herein.

The various components illustrated herein may be realized by any suitable combination of hardware, software, and/or firmware. In the figures, various components are depicted as separate units or modules. However, all or several of the various components described with reference to these figures may be integrated into combined units or modules within common hardware, firmware, and/or software. Accordingly, the representation of features as components, units or modules is intended to highlight particular functional features for ease of illustration, and does not necessarily require realization of such features by separate hardware, firmware, or software components. In some cases, various units may be implemented as programmable processes performed by one or more processors.

Any features described herein as modules, devices, or components may be implemented together in an integrated logic device or separately as discrete but interoperable logic devices. In various aspects, such components may be formed at least in part as one or more integrated circuit devices, which may be referred to collectively as an integrated circuit device, such as an integrated circuit chip or chipset. Such circuitry may be provided in a single integrated circuit chip device or in multiple, interoperable integrated circuit chip devices, and may be used in any of a variety of image, display, audio, or other multi-multimedia applications and devices. In some aspects, for example, such components may form part of a mobile device, such as a wireless communication device handset (e.g., a mobile telephone handset).

If implemented in software, the techniques may be realized at least in part by a computer-readable data storage medium comprising code with instructions that, when executed by one or more processors, performs one or more of the methods described above. The computer-readable storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), embedded dynamic random access memory (eDRAM), static random access memory (SRAM), flash memory, magnetic or optical data storage media. Any software that is utilized may be executed by one or more processors, such as one or more DSP's, general purpose microprocessors, ASIC's, FPGA's, or other equivalent integrated or discrete logic circuitry.

Various aspects have been described in this disclosure. These and other aspects are within the scope of the following claims.

The invention claimed is:

1. A method of transmitting data, comprising:

identifying, with a first communication device, at least one channel currently available in a digital broadcast spectrum;

receiving, with the first communication device, data sent from a second communication device, wherein the data sent from the second communication device comprises display information of the second communication device, and wherein the display information comprises primary display data that is displayed on the second communication device and secondary display data that is different from the primary display data; and transmitting the data from the first communication device in the at least one identified channel of the digital broadcast spectrum, wherein the transmitted data complies with a digital broadcast format.

2. The method of claim 1, wherein:

receiving the data sent from the second communication device comprises receiving the data sent from the second communication device over a wireless network.

3. The method of claim 2, wherein the wireless network is different from a broadcast network for the digital broadcast spectrum.

4. The method of claim 1, wherein:

transmitting the data from the first communication device in the at least one identified channel comprises transmitting the primary display data.

5. The method of claim 1, wherein:

transmitting the data from the first communication device in the at least one identified channel comprises transmitting the secondary display data.

6. The method of claim 1, wherein:

the data sent from the second communication device comprises data provided by a human interface device of the second communication device; and transmitting the data from the first communication device in the at least one identified channel comprises transmitting the data provided by the human interface device to an external device, wherein the data provided by the human interface device is capable of being used by the external device to control an icon that is displayed by the external device.

7. The method of claim 6, wherein the human interface device of the second communication device comprises a touch interface.

8. The method of claim 1, wherein:

identifying the at least one channel comprises identifying the at least one channel in an unused portion of a digital broadcast television spectrum; and transmitting the data comprises transmitting the data according to a digital broadcast format in the at least one identified channel of the digital broadcast television spectrum.

9. The method of claim 8, wherein the digital broadcast format comprises an ATSC (Advanced Television Systems Committee) format, a T-DMB (Terrestrial Digital Multimedia Broadcasting) format, a DVB (Digital Video Broadcasting) format, an Integrated Services Digital Broadcasting Terrestrial (ISDB-T) format, or a Moving Picture Experts Group Transport Stream (MPEG-TS) format.

10. The method of claim 1, wherein identifying the at least one channel comprises identifying television band white space.

11. The method of claim 1, wherein:

receiving the data comprises receiving data of a first data format from the second communication device;

the method further comprises transforming, by the first communication device, the data of the first data format into data of a second data format, the second data format being compliant with the digital broadcast format; and transmitting the data comprises transmitting the data of the second format from the first communication device in the at least one identified channel.

12. The method of claim 11, wherein the data of the first data format and the data of the second data format each include at least one of audio data, video data, text data, speech data, graphics data, and ancillary interactivity data.

13. The method of claim 11, wherein transforming the data of the first data format into data of the second data format comprises encoding the data of the first data format to generate encoded data that complies with the second data format.

14. The method of claim 11, wherein transforming the data of the first data format into data of the second data format comprises transcoding the data of the first data format into the data of the second data format.

15. The method of claim 14, wherein the transcoding comprises transcoding the data of the first data format into the data of the second data format based upon a set of features that are common to and supported by both the first data format and the second data format.

16. The method of claim 14, wherein:

transcoding comprises transcoding video data from the first data format into video data of the second data format;

the first data format comprises a Motion Picture Experts Group (MPEG) 4 format; and the second data format comprises an MPEG-2 format.

17. The method of claim 11, further comprising:

sending information from the first communication device to the second communication device to specify the second data format.

18. The method of claim 1, wherein:

receiving the data sent from the second communication device comprises receiving data of a digital broadcast format.

19. The method of claim 1, wherein identifying the at least one channel comprises using a spectrum sensor to identify the at least one channel.

20. The method of claim 1, further comprising determining a geographic location of the first communication device, and wherein:

identifying the at least one channel comprises accessing a digital television (TV) bands database to identify the at least one channel; and accessing the digital TV bands database comprises providing the geographic location as input to the digital TV bands database.

21. The method of claim 20, wherein determining the geographic location comprises determining the geographic location using a Global Positioning System (GPS) sensor that is included within the first communication device or providing an Internet Protocol (IP) address of the first communication device to an external server in order to obtain an estimated location of the first communication device from the external server.

22. The method of claim 1, wherein identifying the at least one channel comprises identifying multiple available channels of the digital broadcast spectrum, wherein the method further comprises receiving a selection of at least one of the multiple available channels, and wherein transmitting the data comprises transmitting the data in at least one of the selected channels.

23. The method of claim 1, wherein the second communication device is docked.

24. A communication device, comprising:

one or more processors;

a channel identifier operable by the one or more processors to identify at least one channel currently available in a digital broadcast spectrum;

a receiver operable by the one or more processors to receive data sent from a second communication device, wherein the data sent from the second communication device comprises display information of the second communication device, and wherein the display information comprises primary display data that is displayed on the second communication device and secondary display data that is different from the primary display data; and a transmitter operable by the one or more processors to transmit the data in the at least one identified channel of the digital broadcast spectrum, wherein the transmitted data complies with a digital broadcast format.

25. The communication device of claim 24, wherein the receiver receives the data sent from the second communication device at least by receiving the data sent from the second communication device over a wireless network.

26. The communication device of claim 25, wherein the wireless network is different from the digital broadcast spectrum.

27. The communication device of claim 24, wherein:

the transmitter transmits the data in the at least one identified channel comprises transmitting the primary display data.

28. The communication device of claim 24, wherein:

the transmitter transmits the data in the at least one identified channel at least by transmitting the secondary display data.

29. The communication device of claim 24, wherein:

the data sent from the second communication device comprises data provided by a human interface device of the second communication device; and the transmitter transmits the data in the at least one identified channel at least by transmitting the data provided by the human interface device to an external device, wherein the data provided by the human interface device is capable of being used by the external device to control an icon that is displayed by the external device.

30. The communication device of claim 29, wherein the human interface device of the second communication device comprises a touch interface.

31. The communication device of claim 24, wherein:

the channel identifier identifies the at least one channel in an unused portion of a digital broadcast television spectrum; and the transmitter transmits the data according to a digital broadcast format in the at least one identified channel of the digital broadcast television spectrum.

32. The communication device of claim 31, wherein the digital broadcast format comprises an ATSC (Advanced Television Systems Committee) format, a T-DMB (Terrestrial Digital Multimedia Broadcasting) format, a DVB (Digital Video Broadcasting) format, an Integrated Services Digital Broadcasting Terrestrial (ISDB-T) format, or a Moving Picture Experts Group Transport Stream (MPEG-TS) format.

33. The communication device of claim 24, wherein the channel identifier identifies the at least one channel at least by identifying television band white space.

34. The communication device of claim 24, wherein:

the receiver receives data of a first data format from the second communication device;

the communication device further comprises a transformation unit to transform the data of the first data format into data of a second data format, the second data format being compliant with the digital broadcast format; and the transmitter transmits the data of the second format in the at least one identified channel.

35. The communication device of claim 34, wherein the data of the first data format and the data of the second data format each include at least one of audio data, video data, text data, speech data, graphics data, and ancillary interactivity data.

36. The communication device of claim 34, wherein the transformation unit transforms the data of the first data format into data of the second data format at least by encoding the data of the first data format to generate encoded data that complies with the second data format.

37. The communication device of claim 34, wherein the transformation unit transforms the data of the first data format into data of the second data format at least by transcoding the data of the first data format into the data of the second data format.

38. The communication device of claim 37, wherein the transformation unit transcodes the data of the first data format into the data of the second data format based upon a set of features that are common to and supported by both the first data format and the second data format.

39. The communication device of claim 37, wherein:

the transformation unit transcodes video data from the first data format into video data of the second data format;

the first data format comprises a Motion Picture Experts Group (MPEG) 4 format; and the second data format comprises an MPEG-2 format.

40. The communication device of claim 34, wherein the communication device is further configured to send information to the second communication device that specifies the second data format.

41. The communication device of claim 24, wherein the receiver receives the data sent from the second communication device at least by receiving data of a digital broadcast format.

42. The communication device of claim 24, wherein the channel identifier comprises a spectrum sensor.

43. The communication device of claim 24, wherein the channel identifier identifies the at least one channel at least by accessing a digital television (TV) bands database to identify the at least one channel.

44. The communication device of claim 24, wherein the second communication device is docked.

45. The communication device of claim 24, wherein the communication device comprises a wireless communication device handset.

46. The communication device of claim 24, wherein the communication device comprises one or more integrated circuit devices.

47. A communication device, comprising:

means for identifying at least one channel currently available in a digital broadcast spectrum;

means for receiving data sent from a second communication device, wherein the data sent from the second communication device comprises display information of the second communication device, and wherein the display information comprises primary display data that is displayed on the second communication device and secondary display data that is different from the primary display data; and means for transmitting the data in the at least one identified channel of the digital broadcast spectrum, wherein the transmitted data complies with a digital broadcast format.

48. The communication device of claim 47, wherein:

the means for receiving the data sent from the second communication device comprises means for receiving the data sent from the second communication device over a wireless network.

49. The communication device of claim 48, wherein the wireless network is different from the digital broadcast spectrum.

50. The communication device of claim 47, wherein:

the means for transmitting the data in the at least one identified channel comprises means for transmitting the primary display data.

51. The communication device of claim 47, wherein:

the means for transmitting the data in the at least one identified channel comprises means for transmitting the secondary display data.

52. The communication device of claim 47, wherein:

the data sent from the second communication device comprises data provided by a human interface device of the second communication device; and the means for transmitting the data in the at least one identified channel comprises means for transmitting the data provided by the human interface device to an external device, wherein the data provided by the human interface device is capable of being used by the external device to control an icon that is displayed by the external device.

53. The communication device of claim 47, wherein:

the means for receiving the data sent from the second communication device comprises means for receiving data of a digital broadcast format.

54. The communication device of claim 47, wherein:

the means for identifying the at least one channel comprises means for identifying the at least one channel in an unused portion of a digital broadcast television spectrum; and the means for transmitting the data comprises means for transmitting the data according to a digital broadcast format in the at least one identified channel of the digital broadcast television spectrum.

55. The communication device of claim 47, wherein:

the means for receiving the data comprises means for receiving data of a first data format from the second communication device;

the communication device further comprises means for transforming the data of the first data format into data of a second data format, the second data format being compliant with the digital broadcast format; and the means for transmitting the data comprises means for transmitting the data of the second format in the at least one identified channel.

56. The communication device of claim 55, wherein the means for transforming the data of the first data format into data of the second data format comprises means for transcoding the data of the first data format into the data of the second data format based upon a set of features that are common to and supported by both the first data format and the second data format.

57. A non-transitory computer-readable storage medium encoded with instructions for causing one or more processors of a communication device to:

identify at least one channel currently available in a digital broadcast spectrum;

receive data sent from a second communication device, wherein the data sent from the second communication device comprises display information of the second communication device, and wherein the display information comprises primary display data that is displayed on the second communication device and secondary display data that is different from the primary display data; and transmit the data in the at least one identified channel of the digital broadcast spectrum, wherein the transmitted data complies with a digital broadcast format.

58. The non-transitory computer-readable storage medium of claim 57, wherein:

the instructions to receive the data sent from the second communication device comprise instructions to receive the data sent from the second communication device over a wireless network.

59. The non-transitory computer-readable storage medium of claim 58, wherein the wireless network is different from the digital broadcast spectrum.

60. The non-transitory computer-readable storage medium of claim 57, wherein:

the instructions to transmit the data in the at least one identified channel comprise instructions to transmit the primary display data.

61. The non-transitory computer-readable storage medium of claim 57, wherein:

the instructions to transmit the data in the at least one identified channel comprise instructions to transmit the secondary display data.

62. The non-transitory computer-readable storage medium of claim 57, wherein:

the data sent from the second communication device comprises data provided by a human interface device of the second communication device; and the instructions to transmit the data in the at least one identified channel comprise instructions to transmit the data provided by the human interface device to an external device, wherein the data provided by the human interface device is capable of being used by the external device to control an icon that is displayed by the external device.

63. The non-transitory computer-readable storage medium of claim 57, wherein:

the instructions to receive the data sent from the second communication device comprise instructions to receive data of a digital broadcast format.

64. The non-transitory computer-readable storage medium of claim 57, wherein:

the instructions to identify the at least one channel comprise instructions to identify the at least one channel in an unused portion of a digital broadcast television spectrum; and the instructions to transmit the data comprise instructions to transmit the data according to a digital broadcast format in the at least one identified channel of the digital broadcast television spectrum.

65. The non-transitory computer-readable storage medium of claim 57, wherein:

the instructions to receive the data comprise instructions to receive data of a first data format from the second communication device;

the computer-readable storage medium further comprises instructions to transform the data of the first data format into data of a second data format, the second data format being compliant with the digital broadcast format; and the instructions to transmit the data comprise instructions to transmit the data of the second format in the at least one identified channel.

66. The non-transitory computer-readable storage medium of claim 65, wherein the instructions to transform the data of the first data format into data of the second data format comprise instructions to transcode the data of the first data format into the data of the second data format based upon a set of features that are common to and supported by both the first data format and the second data format.

* * * * *